US011913732B2

(12) United States Patent
O et al.

(10) Patent No.: US 11,913,732 B2
(45) Date of Patent: Feb. 27, 2024

(54) BULKHEAD HEAT EXCHANGER INCLUDING HEAT TRANSFER SURFACES HAVING IMPROVED HEAT TRANSFER PERFORMANCE

(71) Applicant: FUJITSU GENERAL LIMITED, Kanagawa (JP)

(72) Inventors: Gaiken O, Kanagawa (JP); Toshihiko Takahashi, Kanagawa (JP); Akira Koizumi, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 0 days.

(21) Appl. No.: 16/976,223

(22) PCT Filed: Jan. 24, 2019

(86) PCT No.: PCT/JP2019/002358
§ 371 (c)(1),
(2) Date: Aug. 27, 2020

(87) PCT Pub. No.: WO2019/167491
PCT Pub. Date: Sep. 6, 2019

(65) Prior Publication Data

US 2021/0003351 A1 Jan. 7, 2021

(30) Foreign Application Priority Data

Feb. 28, 2018 (JP) ..... 2018-035321

(51) Int. Cl.
*F28F 3/02* (2006.01)
*F28D 9/00* (2006.01)
*F28F 3/04* (2006.01)

(52) U.S. Cl.
CPC ..... *F28F 3/025* (2013.01); *F28D 9/0068* (2013.01); *F28F 3/048* (2013.01); *F28F 2260/02* (2013.01)

(58) Field of Classification Search
CPC ..... F28F 27/006; F28F 3/048; F28F 3/025; F28F 2260/02; F28D 9/0068
See application file for complete search history.

(56) References Cited

U.S. PATENT DOCUMENTS 7,334,631 B2 * 2/2008 Kato ..... F28D 9/005 165/166
7,810,552 B2 * 10/2010 Slaughter ..... F28F 7/02 165/148

(Continued)

FOREIGN PATENT DOCUMENTS

CN 101209669 A 7/2008
CN 103994687 A 8/2014

(Continued)

OTHER PUBLICATIONS

May 31, 2021, Chinese Office Action issued for related CN application No. 201980015644.9.

(Continued)

*Primary Examiner* — Paul Alvare
(74) *Attorney, Agent, or Firm* — Paratus Law Group, PLLC

(57) ABSTRACT

A bulkhead heat exchanger includes a first bulkhead, a second bulkhead, and a plurality of flow path walls which divide a space formed between the first bulkhead and the second bulkhead into a plurality of first flow paths, wherein the first bulkhead and the second bulkhead separate the plurality of first flow paths from a plurality of second flow paths through which a second fluid different from a first fluid flowing through the plurality of first flow paths flows, the plurality of flow path walls have the plurality of wall (Continued)

surfaces, and the plurality of wall surfaces conform to sine curves different from each other, respectively.

9 Claims, 13 Drawing Sheets

(56) References Cited

U.S. PATENT DOCUMENTS

| | | | | |
|---|---|---|---|---|
| 8,474,516 | B2 * | 7/2013 | Valenzuela | F28F 3/12 165/166 |
| 8,475,626 | B2 * | 7/2013 | Rops | F28D 9/0031 159/28.5 |
| 9,291,404 | B2 * | 3/2016 | Tamura | F28F 3/048 |
| 9,689,620 | B2 * | 6/2017 | Yamada | F28F 3/048 |
| 10,178,805 | B2 * | 1/2019 | Ramm | H05K 7/20263 |
| 2001/0042386 | A1 * | 11/2001 | Allam | F25J 3/0486 62/903 |
| 2006/0090887 | A1 | 5/2006 | Kato et al. | |
| 2010/0051248 | A1 * | 3/2010 | Inatomi | F28F 3/04 165/166 |
| 2013/0327513 | A1 * | 12/2013 | Franz | F28F 21/04 165/185 |
| 2015/0122467 | A1 * | 5/2015 | Shi | F28F 3/048 165/166 |

FOREIGN PATENT DOCUMENTS

| | | | |
|---|---|---|---|
| CN | 104880106 | A | 9/2015 |
| CN | 207035929 | U | 2/2018 |
| JP | 2003-090692 | A | 3/2003 |
| JP | 2006-125767 | A | 5/2006 |
| JP | 2009-068736 | A | 4/2009 |
| JP | 2013-534608 | A | 9/2013 |
| JP | 2017-106648 | A | 6/2017 |
| WO | WO 2008/062802 | A1 | 5/2008 |
| WO | WO 2008/080305 | A1 | 7/2008 |

OTHER PUBLICATIONS

Oct. 26, 2021, European Search Report issued for related EP Application No. 19761573.5.

* cited by examiner

BULKHEAD HEAT EXCHANGER INCLUDING HEAT TRANSFER SURFACES HAVING IMPROVED HEAT TRANSFER PERFORMANCE

CROSS REFERENCE TO PRIOR APPLICATION

This application is a National Stage Patent Application of PCT International Patent Application No. PCT/JP2019/002358 (filed on Jan. 24, 2019) under 35 U.S.C. §371, which claims priority to Japanese Patent Application No. 2018-035321 (filed on Feb. 28, 2018), which are all hereby incorporated by reference in their entirety.

FIELD

A technique of the present disclosure relates to a bulkhead heat exchanger.

BACKGROUND

It has been known a bulkhead heat exchanger which performs heat exchange between fluids separated by a bulkhead. The bulkhead heat exchanger can be made compact by determining a heat transfer area required for heat exchange of each fluid in consideration of a heat conductance equilibrium condition (refer to Patent Literature 1).

CITATION LIST

Patent Literature

Patent Literature 1: Japanese Laid-open Patent Publication No. 2009-68736

SUMMARY

Technical Problem

Meanwhile, in a bulkhead heat exchanger of the related art, a development in a shape of a heat transfer surface for improving heat transfer performance of a heat exchanger is advanced by trial and error. Therefore, in the bulkhead heat exchanger, there is a problem in that it is difficult to optimize the shape of the heat transfer surface.

The technique of the present disclosure is made in consideration of the above circumstances, and an object thereof is to provide a bulkhead heat exchanger including a heat transfer surface having a shape which improves heat transfer performance while achieving a compact heat exchanger.

Solution to Problem

According to the technique of the present disclosure, a bulkhead heat exchanger includes a first bulkhead, a second bulkhead, and a plurality of flow path walls which divide a space formed between the first bulkhead and the second bulkhead into a plurality of first flow paths. The first bulkhead and the second bulkhead separate the plurality of first flow paths from second flow paths through which a second fluid different from a first fluid flowing through the plurality of first flow paths flows, the plurality of flow path walls have a plurality of wall surfaces. The plurality of wall surfaces conform to sine curves different from each other, respectively.

Advantageous Effects of Invention

According to the bulkhead heat exchanger of the present disclosure, it is possible to improve heat transfer performance while achieving a compact heat exchanger.

DESCRIPTION OF EMBODIMENTS

Hereinafter, bulkhead heat exchangers according to embodiments disclosed in the present application will be described with reference to the drawings. A technique disclosed in the present application is not limited by the following description. Moreover, in the following description, the same reference signs are assigned to the same components, and repeated descriptions thereof are omitted.

First Embodiment

Figure 1:
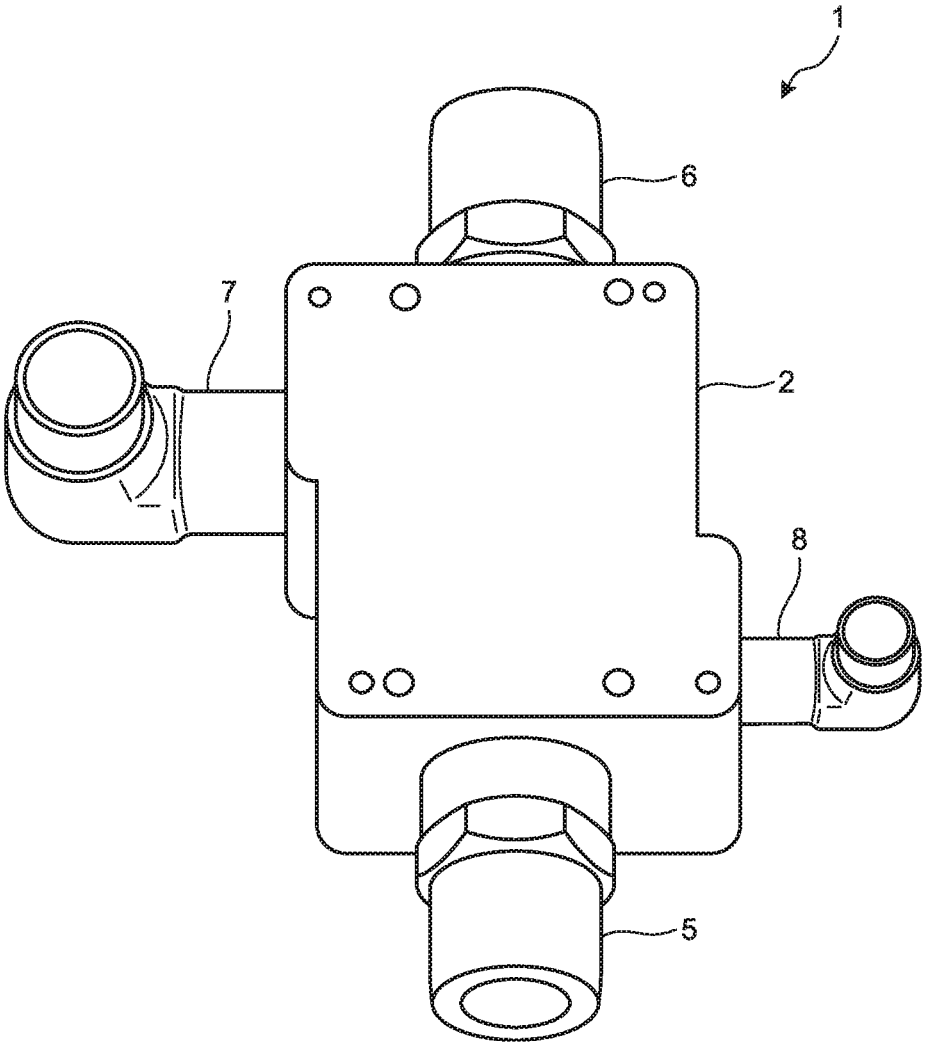
FIG. 1 is a perspective view illustrating a bulkhead heat exchanger of a first embodiment.

FIG. 1 is a perspective view illustrating a bulkhead heat exchanger 1 of a first embodiment. The bulkhead heat exchanger 1 according to the first embodiment includes a heat exchanger body 2, a first inflow pipe 5, a first outflow pipe 6, a second inflow pipe 7, and a second outflow pipe 8, as illustrated in FIG. 1. A first fluid flows into the heat exchanger body 2 through the first inflow pipe 5. The first fluid, which has been heat-exchanged with a second fluid in the heat exchanger body 2, flows from the heat exchanger body 2 to the outside through the first outflow pipe 6. The second fluid flows into the heat exchanger body 2 through the second inflow pipe 7. The second fluid, which has been heat-exchanged with the first fluid in the heat exchanger body 2, flows from the heat exchanger body 2 to the outside through the second outflow pipe 8.

Figure 2:
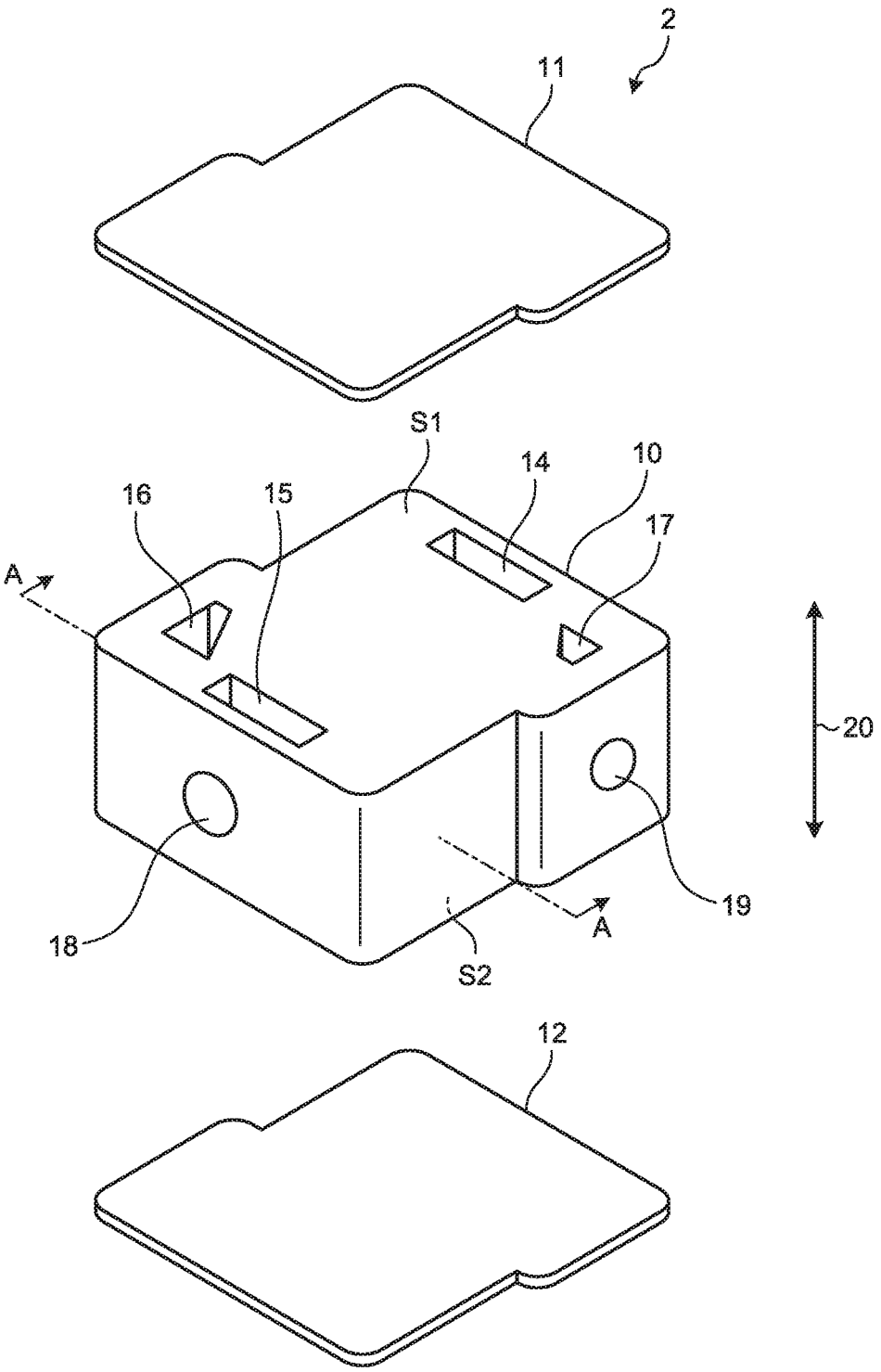
FIG. 2 is an exploded perspective view illustrating a heat exchanger body.

FIG. 2 is an exploded perspective view illustrating the heat exchanger body 2. The heat exchanger body 2 of FIG. 2 is a view in which the bulkhead heat exchanger 1 of FIG. 1 is rotated by 180° about a pipe axis of the second inflow pipe 7 or the second outflow pipe 8. As illustrated in FIG. 2, the heat exchanger body 2 includes a laminated body 10, a first end plate 11, and a second end plate 12. The laminated body 10 is formed into a columnar body. The first end plate 11 covers one bottom surface S1 of the laminated body 10 which is a columnar body, and is fixed to the laminated body 10. The second end plate 12 covers the other bottom surface S2 on a side opposite to the bottom surface S1 of the laminated body 10 which is a columnar body and is fixed to the laminated body 10.

The heat exchanger body 2 includes a first inflow chamber 14, a first outflow chamber 15, a second inflow chamber 16, and a second outflow chamber 17. Both ends of four through holes penetrating the laminated body 10 in a lamination direction 20 of the laminated body 10 described later are closed by the first end plate 11 and the second end plate 12, and thus, the first inflow chamber 14, the first outflow chamber 15, the second inflow chamber 16, and the second outflow chamber 17 are formed.

The laminated body 10 further includes a first outflow hole 18 and a second outflow hole 19. The first outflow hole 18 is formed on a side surface near the first outflow chamber 15 among side surfaces of the laminated body 10, and connects the first outflow chamber 15 and the outside of the heat exchanger body 2 to each other. In this case, in the first outflow pipe 6, one end thereof is fixed to the laminated body 10 to be inserted into the first outflow hole 18 and to face the first outflow chamber 15, and the other end thereof is disposed outside the heat exchanger body 2. The second outflow hole 19 is formed on a side surface near the second outflow chamber 17 among the side surfaces of the laminated body 10, and connects the inside of the second outflow chamber 17 and the outside of the heat exchanger body 2 to each other. In this case, in the second outflow pipe 8, one end thereof is fixed to the laminated body 10 to be inserted into the second outflow hole 19 and to face the second outflow chamber 17, and the other end thereof is disposed outside the heat exchanger body 2.

The laminated body 10 further includes a first inflow hole (not illustrated) and a second inflow hole (not illustrated). The first inflow hole is formed on a side surface near the first inflow chamber 14 among the side surfaces of the laminated body 10, and connects the inside of the first inflow chamber 14 and the outside of the heat exchanger body 2 to each other. In this case, in the first inflow pipe 5, one end thereof is fixed to the laminated body 10 to be inserted into the first inflow hole and to face the first inflow chamber 14, and the other end thereof is disposed outside the heat exchanger body 2. The second inflow hole is formed on a side surface near the second inflow chamber 16 among the side surfaces of the laminated body 10, and connects the inside of the second inflow chamber 16 and the outside of the heat exchanger body 2 to each other. In this case, in the second inflow pipe 7, one end thereof is fixed to the laminated body 10 to be inserted into the second inflow hole and to face the second inflow chamber 16, and the other end thereof is disposed outside the heat exchanger body 2.

The laminated body 10 has a plurality of heat exchanger plates. Each of the plurality of heat exchanger plates is formed in a plate shape. The plurality of heat exchanger plates are disposed perpendicular to the lamination direction 20 and are laminated so as to be in close contact with each other. The plurality of heat exchanger plates has a plurality of first heat exchanger plates and a plurality of second heat exchanger plates. The first heat exchanger plate and the second heat exchanger plate are alternately laminated.

Figure 3:
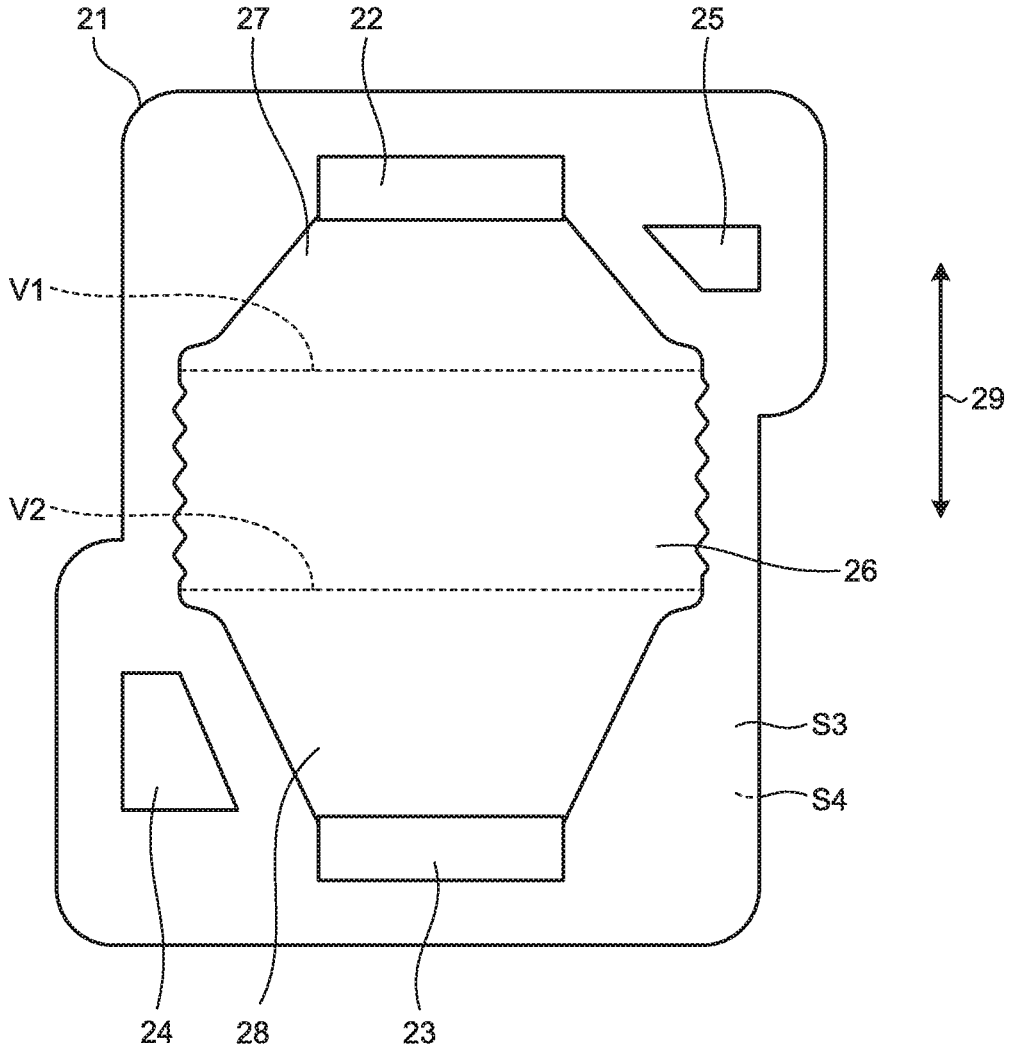
FIG. 3 is a plan view illustrating one first heat exchanger plate among a plurality of first heat exchanger plates.

The plurality of first heat exchanger plates are formed in the same shape as each other. FIG. 3 is a plan view illustrating one first heat exchanger plate 21 of the plurality of first heat exchanger plates. As illustrated in FIG. 3, the first heat exchanger plate 21 includes a first inflow chamber hole 22, a first outflow chamber hole 23, a second inflow chamber hole 24, and a second outflow chamber hole 25. Each of the first inflow chamber hole 22, the first outflow chamber hole 23, the second inflow chamber hole 24, and the second outflow chamber hole 25 penetrate the first heat exchanger plate 21 from one surface S3 of the first heat exchanger plate 21 to the other surface S4 thereof.

In the first heat exchanger plate 21, a first heat exchange flow path recess 26, a first inflow flow path recess 27, and a first outflow flow path recess 28 are further formed on one surface S3. The first heat exchange flow path recess 26 is formed in substantially a center of the first heat exchanger plate 21. The first inflow flow path recess 27 is formed between the first heat exchange flow path recess 26 and the first inflow chamber hole 22, is connected to the first inflow chamber hole 22, and is connected to an edge V1 of the first heat exchange flow path recess 26 on a side of the first inflow chamber hole 22. The first outflow flow path recess 28 is formed between the first heat exchange flow path recess 26 and the first outflow chamber hole 23, is connected to the first outflow chamber hole 23, and is connected to an edge V2 of the first heat exchange flow path recess 26 on a side opposite to the edge V1 connected to the first inflow flow path recess 27 in a flow direction 29. The flow direction 29 represents a direction (a traveling direction of the first fluid flowing along a sinusoidal flow path described later) in which the first fluid as a whole flows through the first heat exchange flow path recess 26, and the flow direction 29 is perpendicular to the lamination direction 20, that is, is parallel to the first heat exchanger plate 21.

Figure 4:
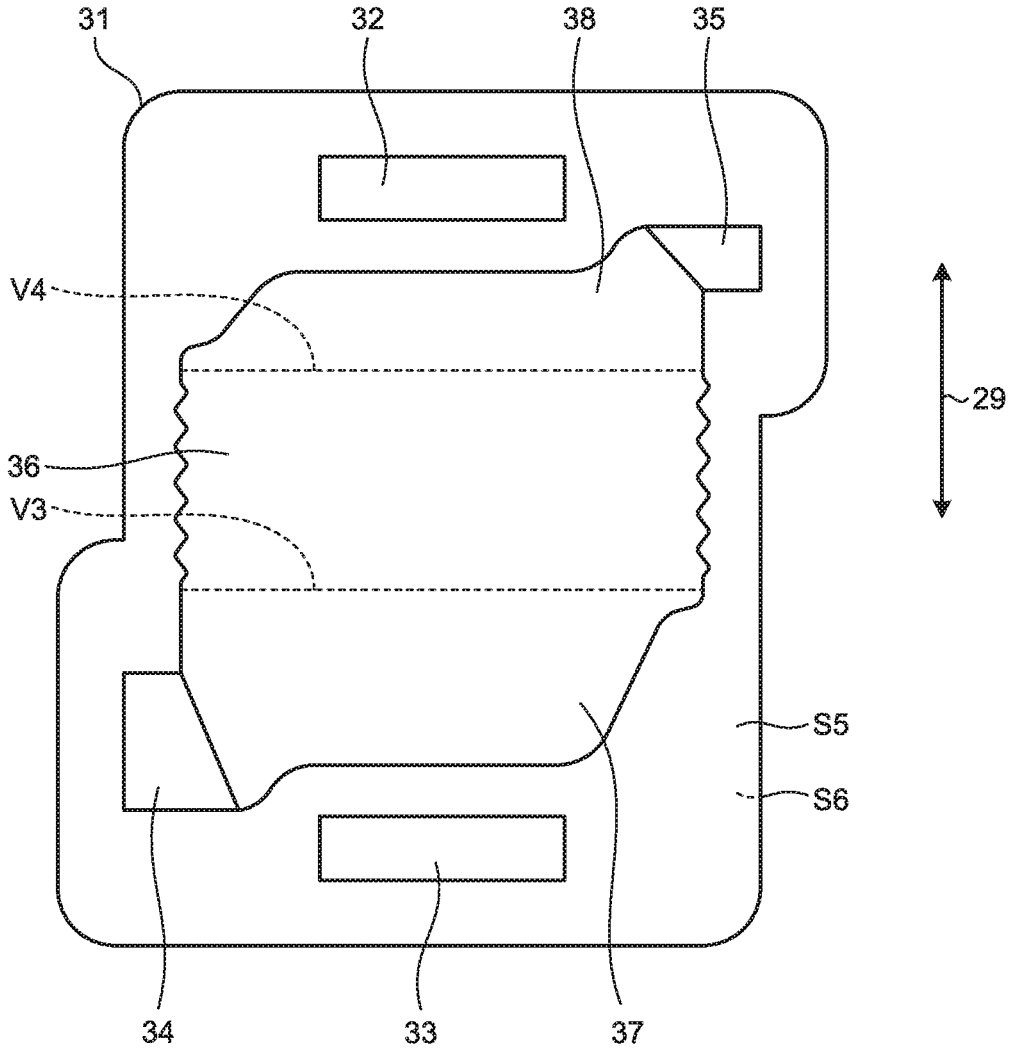
FIG. 4 is a plan view illustrating one second heat exchanger plate among a plurality of second heat exchanger plates.

The plurality of second heat exchanger plates are formed in the same shape as each other. FIG. 4 is a plan view illustrating one second heat exchanger plate 31 among the plurality of second heat exchanger plates. As illustrated in FIG. 4, the second heat exchanger plate 31 includes a first inflow chamber hole 32, a first outflow chamber hole 33, a second inflow chamber hole 34, and a second outflow chamber hole 35. The first inflow chamber hole 32, the first outflow chamber hole 33, the second inflow chamber hole 34, and the second outflow chamber hole 35 penetrate the second heat exchanger plate 31 from one surface S5 of the second heat exchanger plate 31 to the other surface S6 of the second heat exchanger plate 31. The first inflow chamber hole 32 is connected to the first inflow chamber hole 22 of the first heat exchanger plate 21 to form the first inflow chamber 14 when the plurality of heat exchanger plates are appropriately laminated. The first outflow chamber hole 33 is connected to the first outflow chamber hole 23 of the first heat exchanger plate 21 to form the first outflow chamber 15 when the plurality of heat exchanger plates are appropriately laminated. The second inflow chamber hole 34 is connected to the second inflow chamber hole 24 of the first heat exchanger plate 21 to form the second inflow chamber 16 when the plurality of heat exchanger plates are appropriately laminated. The second outflow chamber hole 35 is connected to the second outflow chamber hole 25 of the first heat exchanger plate 21 to form the second outflow chamber 17 when the plurality of heat exchanger plates are appropriately laminated.

The second heat exchanger plate 31 further includes a second heat exchange flow path recess 36, a second inflow flow path recess 37, and a second outflow flow path recess 38 which are formed on one surface S5. The second heat exchange flow path recess 36 is formed in substantially a center of the second heat exchanger plate 31 so as to overlap the first heat exchange flow path recess 26 of the first heat exchanger plate 21 in the lamination direction 20 when the plurality of heat exchanger plates are appropriately laminated. The second inflow flow path recess 37 is formed between the second inflow chamber hole 34 and the second heat exchange flow path recess 36, is connected to the second inflow chamber hole 34, and is connected to an edge V3 of the second heat exchange flow path recess 36 on a side of the first outflow chamber hole 33. The second outflow flow path recess 38 is formed between the second outflow chamber hole 35 and the second heat exchange flow path recess 36, is connected to the second outflow chamber hole 35, and is connected to an edge V4 of the second heat exchange flow path recess 36 on a side opposite to the edge V3 connected to the second inflow flow path recess 37 in a flow direction 29. The flow direction 29 is the same as the flow direction 29 of FIG. 3. In FIG. 4, the flow direction 29 represents a direction (a traveling direction of the second fluid flowing along the sinusoidal flow path described later) in which the second fluid as a whole flows through the second heat exchange flow path recess 36, and the flow direction 29 is perpendicular to the lamination direction 20, that is, is parallel to the second heat exchanger plate 31. Since the flow directions of the first fluid and the second fluid are reversible, the flow direction 29 is indicated by a double-headed arrow in FIGS. 3 and 4.

Figure 5:
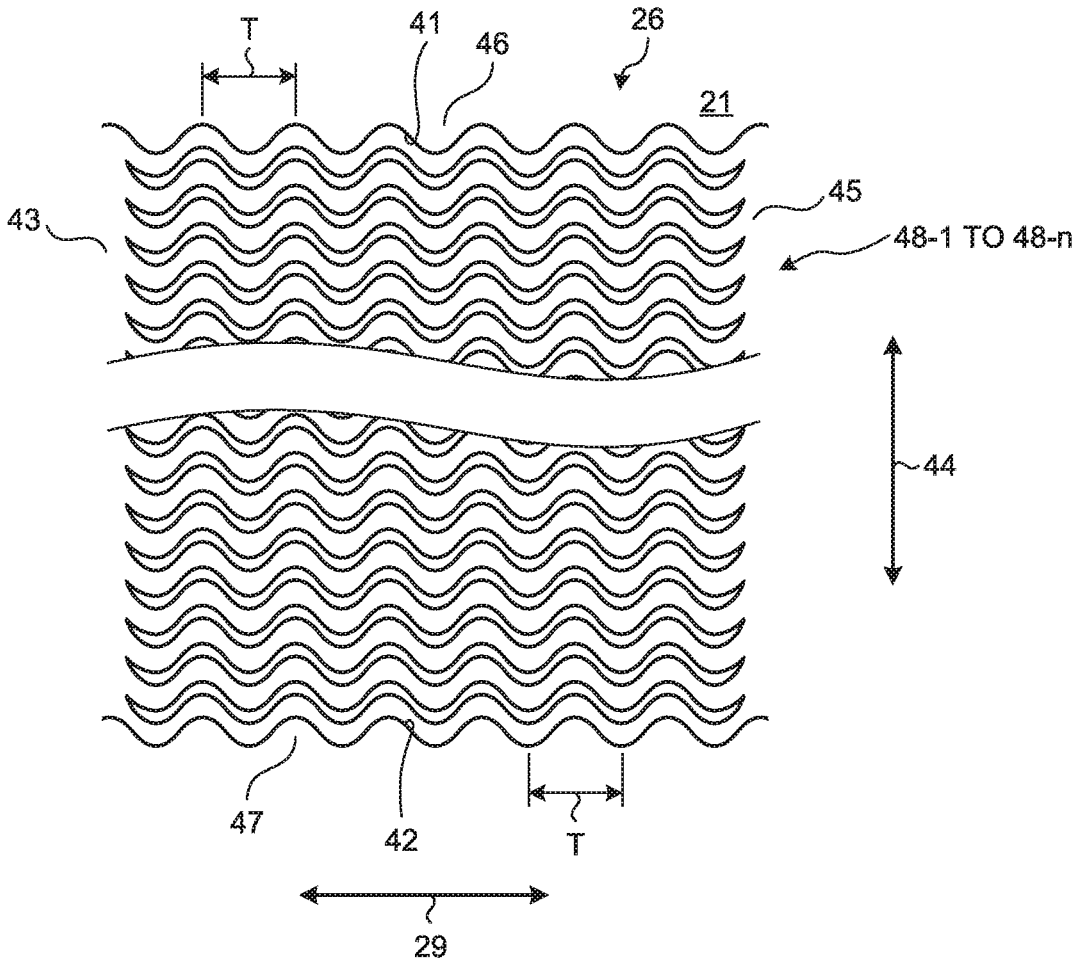
FIG. 5 is a plan view illustrating a first heat exchange flow path recess.

FIG. 5 is a plan view illustrating the first heat exchange flow path recess 26. As illustrated in FIG. 5, in the first heat exchanger plate 21, the first heat exchange flow path recess 26 is formed, and thus, a first sidewall surface 41, a second sidewall surface 42, and a bottom surface 43 are formed. The first sidewall surface 41 is formed on one edge of the first heat exchange flow path recess 26 in a span direction 44 and forms a portion of an inner wall surface of the first heat exchange flow path recess 26. The span direction 44 is perpendicular to the lamination direction 20 and perpendicular to the flow direction 29. The first sidewall surface 41 is substantially perpendicular to a plane to which the first heat exchanger plate 21 is parallel, that is, substantially parallel to the lamination direction 20. The first sidewall surface 41 is formed so as to conform to a sine curve drawn on a plane parallel to the first heat exchanger plate 21. The sine curve to which the first sidewall surface 41 conforms is the same as a waveform represented by a sine function, and an amplitude thereof is changed periodically and smoothly in the flow direction 29. That is, the sine function is expressed by the following Equation (1) using a variable x, a variable y, an amplitude A, and a period T.

$$y=A\sin(2\pi/T\cdot x) \quad (1)$$

Here, the variable x indicates a position in the flow direction 29. The variable y indicates a position in the span direction 44. The amplitude A is exemplified by a value smaller than 1.0 mm, for example, 0.6 mm. For example, the period T is 3 mm.

The second sidewall surface 42 is formed at an edge of the first heat exchange flow path recess 26 on a side opposite to the edge where the first sidewall surface 41 is formed in the span direction 44, and forms a portion of the inner wall surface of the first heat exchange flow path recess 26. The second sidewall surface 42 is substantially perpendicular to the plane to which the first heat exchanger plate 21 conforms, that is, substantially parallel to the lamination direction 20. The second sidewall surface 42 is formed so as to conform to a sine curve drawn on a plane to which the first heat exchanger plate 21 conforms. The sine curve to which the second sidewall surface 42 conforms is the same sine curve to which the first sidewall surface 41 conforms. That is, the period of the sine curve to which the second sidewall surface 42 conforms is equal to the period of the sine curve to which the first sidewall surface 41 conforms, and the amplitude of the sine curve to which the second sidewall surface 42 conforms is equal to the amplitude of the sine curve to which the first sidewall surface 41 conforms. Further, a position in the flow direction 29 of a point corresponding to a phase of the sine curve to which the second sidewall surface 42 conforms is the same as a position in the flow direction 29 of a point of the sine curve to which the first sidewall surface 41 conforms corresponding to the phase.

The bottom surface 43 forms a portion of the inner wall surface of the first heat exchange flow path recess 26, and forms a surface interposed between the first sidewall surface 41 and the second sidewall surface 42 among the inner wall surfaces of the first heat exchange flow path recess 26. The bottom surface 43 is formed to be parallel to the plane to which the first heat exchanger plate 21 is parallel.

The first heat exchanger plate 21 includes a first bulkhead 45, a first sidewall 46, a second sidewall 47, and a plurality of first flow path walls 48-1 to **48-*n* (n is a positive integer, and the same applies hereinafter). The first bulkhead 45 is a portion which forms a bottom of the first heat exchange flow path recess 26, that is, forms the bottom surface 43 of the first heat exchanger plate 21. The first sidewall 46 is a portion which forms one sidewall of the first heat exchange flow path recess 26, that is, forms the first sidewall surface 41 of the first heat exchanger plate 21. The second sidewall 47 is a portion which forms the other sidewall of the first heat exchange flow path recess 26, that is, is a portion of the first heat exchanger plate 21 which forms the second sidewall surface 42. The plurality of first flow path walls 48-1 to 48-*n* are respectively disposed inside the first heat exchange flow path recesses 26 and are formed on the first bulkhead 45 so as to protrude from the bottom surface 43 in the lamination direction 20**.

Figure 6:
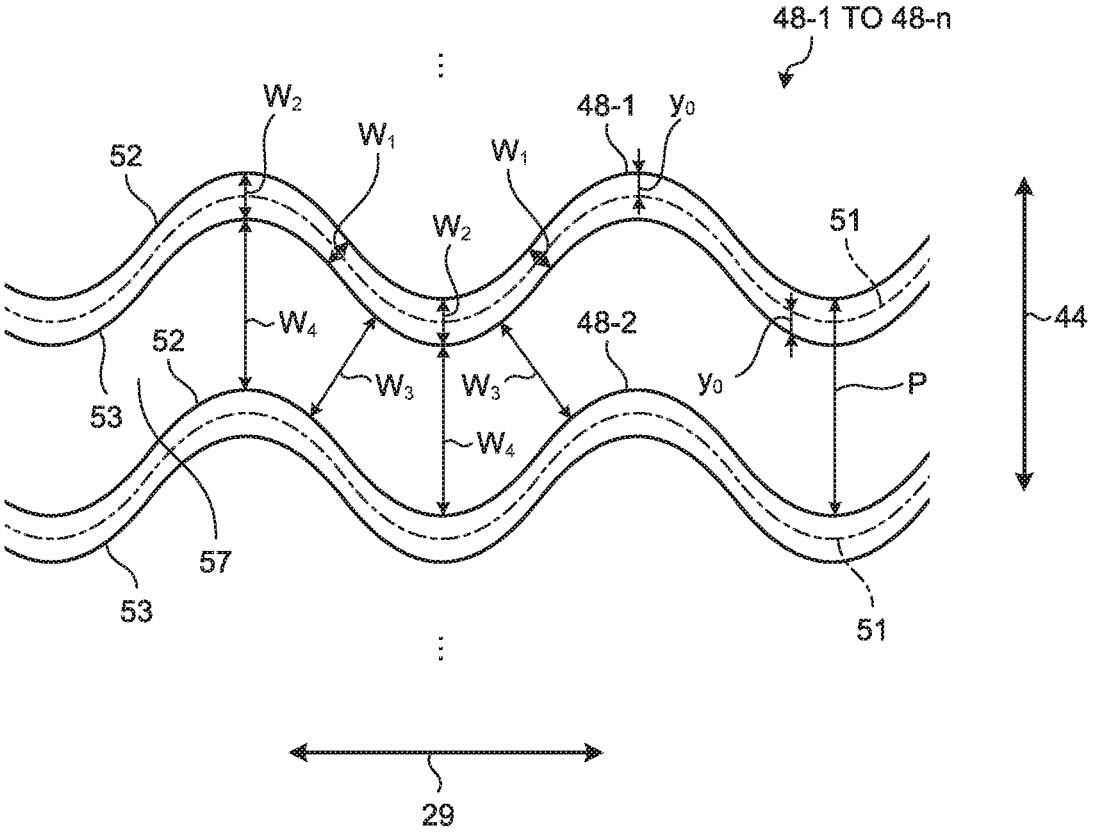
FIG. 6 is a plan view illustrating two adjacent flow path walls among a plurality of first flow path walls.

FIG. 6 is a plan view illustrating two adjacent flow path walls of the plurality of first flow path walls 48-1 to **48-*n*. As illustrated in FIG. 6, one first flow path wall 48-1 of the plurality of first flow path walls 48-1 to 48-*n* is formed to conform to a sine curve 51 drawn on the plane parallel to the first heat exchanger plate 21. The sine curve 51 is the same as the sine curve to which the first sidewall surface 41 or the second sidewall surface 42 expressed by Equation (1) conforms, and is formed so that an amplitude thereof is periodically and smoothly changed in the flow direction 29. That is, the period of the sine curve 51 is equal to the period T of the sine curve to which the first sidewall surface 41 or the second sidewall surface 42 conforms, and the amplitude of the sine curve 51 is equal to the amplitude A of the sine curve to which the first sidewall surface 41 or the second sidewall surface 42 conforms. The first flow path wall 48-1 forms a first side flow path wall surface 52 and a second side flow path wall surface 53. The first side flow path wall surface 52 is formed on the first flow path wall 48-1 on the side of the first sidewall 46. The first side flow path wall surface 52 is formed so as to conform to a sine curve (corresponding to a "first sine curve") drawn on the plane parallel to the first heat exchanger plate 21. The sine curve to which the first side flow path wall surface 52 conforms is the same as the sine curve 51 and is formed to overlap a sine curve which is disposed by translating the sine curve 51 by an offset value $y_0$ to the side of the first sidewall 46 in the span direction 44**. For example, the offset value $y_0$ is 0.1 mm.

The second side flow path wall surface 53 is formed on the first flow path wall 48-1 on the side of the second sidewall 47. The second side flow path wall surface 53 is formed to overlap a sine curve (corresponding to a "second sine curve") which is disposed by translating the sine curve 51 by an offset value $y_0$ to the side of the second sidewall 47 in the span direction 44. The first side flow path wall surface 52 and the second side flow path wall surface 53 are substantially perpendicular to the plane to which the first heat exchanger plate 21 conforms, that is, substantially parallel to the lamination direction 20. The first flow path wall 48-1 is formed in this way. Accordingly, a width $w_1$ of a portion (a portion of the sine curve 51 at an inflection point) of the first flow path wall 48-1 which overlaps the inflection point of the sine curve 51 is narrower than a width $w_2$ of a portion of the first flow path wall 48-1 which overlaps a maximum point or a minimum point of the sine curve 51. The inflection point of the sine curve 51 expressed by the Equation (1) corresponds to a point of a graph of a sine function corresponding to a phase θ expressed by the following Equation (2) using an integer i.

$$\theta=\pi i \tag{2}$$

Further, the maximum point of the sine curve 51 corresponds to a point of a graph of a sine function corresponding to a phase θ represented by the following Equation (3).

$$\theta=\pi/2+2\pi i \tag{3}$$

Moreover, the minimum point of the sine curve 51 corresponds to a point of a graph of a sine function corresponding to a phase θ represented by the following Equation (4).

$$\theta=3\pi/2+2\pi i \tag{4}$$

The adjacent first flow path wall 48-2 disposed on the side of the second sidewall 47 of the first flow path wall 48-1 among the plurality of first flow path walls 48-1 to **48-*n* is formed similarly to the first flow path wall 48-1. That is, the first flow path wall 48-2 is formed so as to conform to the sine curve 51, and includes the first side flow path wall surface 52 and the second side flow path wall surface 53. Moreover, the first flow path wall 48-2 is disposed so that the sine curve 51 to which the first flow path wall 48-2 conforms overlaps a sine curve disposed by translating the sine curve 51 to which the first flow path wall 48-1 conforms by a predetermined pitch P in the span direction 44. For example, the pitch P is 0.75 mm. The other first flow path walls except for the first flow path wall 48-1 and the first flow path wall 48-2 among the plurality of first flow path walls 48-1 to 48-*n* are also formed similarly to the first flow path wall 48-1 and the first flow path wall 48-2. That is, the plurality of first flow path walls 48-1 to 48-*n* are formed so as to be disposed at equal intervals at the pitch P in the span direction 44**.

The first heat exchanger plate 21 has a plurality of grooves formed by forming the plurality of first flow path walls 48-1 to **48-*n*. Each groove 57 is formed between two adjacent first flow path walls of the plurality of first flow path walls 48-1 to 48-*n*, and is formed between the first side flow path wall surface 52 of one first flow path wall and the second side flow path wall surface 53 of the other first flow path wall. The first side flow path wall surface 52 and the second side flow path wall surface 53 conform to the same sine curve. Accordingly, the groove 57 is formed so that a width $w_3$ of a portion close to the inflection point of the sine curve 51 is narrower than a width $w_4$ of a portion close to the maximum point or the minimum point of the sine curve 51**.

Figure 7:
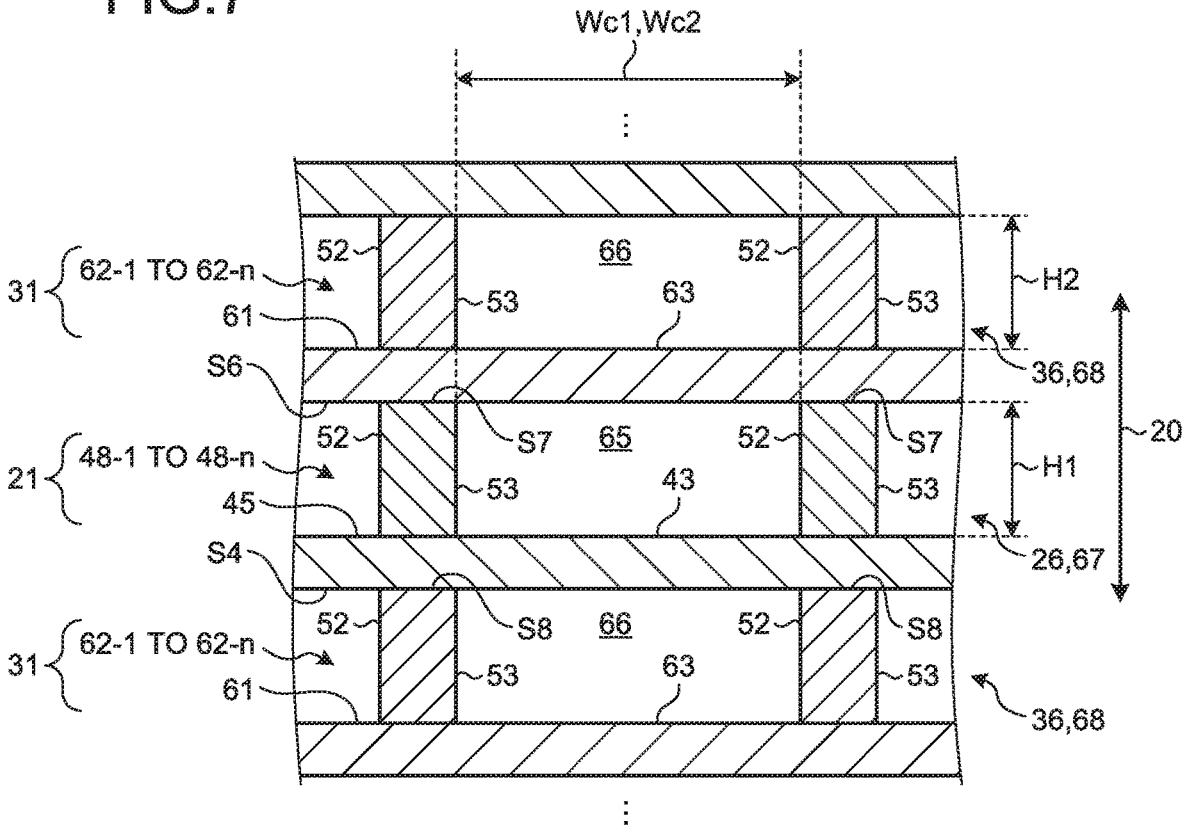
FIG. 7 is an enlarged cross-sectional view taken along line A-A of FIG. 2.

The second heat exchange flow path recesses 36 of the second heat exchanger plate 31 are formed similarly to the first heat exchange flow path recesses 26 of the first heat exchanger plate 21. FIG. 7 is an enlarged cross-sectional view taken along line A-A of FIG. 2. As illustrated in FIG. 7, the second heat exchanger plate 31 includes a second bulkhead 61 and a plurality of second flow path walls 62-1 to **62-*n*. Similarly to the first bulkhead 45 of the first heat exchanger plate 21, the second bulkhead 61 forms a bottom of the second heat exchange flow path recess 36, that is, a bottom surface 63 parallel to the second heat exchanger plate 31. Similarly to the plurality of first flow path walls 48-1 to 48-*n* of the first heat exchanger plate 21, the plurality of second flow path walls 62-1 to 62-*n* are disposed inside the second heat exchange flow path recess 36 and are formed in the second bulkhead 61 to protrude from the bottom surface 63 in the lamination direction 20. Moreover, the plurality of second flow path walls 62-1 to 62-*n* are formed to have the same shapes as those of the plurality of first flow path walls 48-1 to 48-*n* of the first heat exchanger plate 21. The second heat exchanger plate 31 further includes two sidewalls (not illustrated). Similarly to the first sidewall 46 and the second sidewall 47 of the first heat exchanger plate 21, the two sidewalls are respectively formed on both ends of the second heat exchange flow path recess 36 in the span direction 44 and respectively form two sidewall surfaces excluding the bottom surface 63 among inner wall surfaces of the second heat exchange flow path recess 36**.

In the plurality of heat exchanger plates, one surface S3 of the first heat exchanger plate 21 is joined to the other surface S6 of the second heat exchanger plate 31, one surface S5 of the second heat exchanger plate 31 is joined to the other surface S4 of the first heat exchanger plate 21, and thus, the plurality of heat exchanger plates are laminated. That is, the laminated body 10 is formed by joining the plurality of heat exchanger plates to each other in a state where the first heat exchanger plates 21 and the second heat exchanger plates 31 are alternately laminated in this way. The plurality of second flow path walls 62-1 to **62-*n* are formed to overlap the plurality of first flow path walls 48-1 to 48-*n* in the lamination direction 20 when the plurality of heat exchanger plates are appropriately laminated. Tops S7 of the plurality of first flow path walls 48-1 to 48-*n* are joined to the other surface S6 of the second bulkhead 61 and tops S8 of the plurality of second flow path walls 62-1 to 62-*n* are joined to the other surface S4 of the first bulkhead 45. Further, although not illustrated, the first sidewall 46 and the second sidewall 47 of the first heat exchanger plate 21 are formed to respectively overlap two sidewalls of the second heat exchanger plate 31 in the lamination direction 20** when a plurality of heat exchanger plates are appropriately laminated.

In the laminated body 10, a plurality of heat exchanger plates are laminated to form a plurality of first spaces 67 and a plurality of second spaces 68. The first space 67 is a space which is located inside the first heat exchange flow path recess 26 of the first heat exchanger plate 21 and is formed between the first bulkhead 45 and the second bulkhead 61. The plurality of first flow path walls 48-1 to **48-*n* divide the first space 67 inside the first heat exchange flow path recess 26 into a plurality of first flow paths 65. The plurality of first flow paths 65 include a plurality of flow paths surrounded by the plurality of first flow path walls 48-1 to 48-*n*, the first bulkhead 45, and the second bulkhead 61. Although not illustrated, the plurality of first flow paths 65 further include a flow path surrounded by the first sidewall 46, one flow path wall 48-1, the first bulkhead 45, and the second bulkhead 61, and a flow path surrounded by the second sidewall 47, one flow path wall 48-*n*, the first bulkhead 45, and the second bulkhead 61**.

The second space 68 is a space which is located inside the second heat exchange flow path recess 36 of the second heat exchanger plate 31 and is formed between the first bulkhead 45 and the second bulkhead 61. Similarly to the plurality of first flow path walls 48-1 to **48-*n*, the plurality of second flow path walls 62-1 to 62-*n* divide the second space 68 inside the second heat exchange flow path recess 36 into a plurality of second flow paths 66. The plurality of second flow paths 66 include a plurality of flow paths surrounded by the plurality of second flow path walls 62-1 to 62-*n*, the first bulkhead 45, and the second bulkhead 61. Although not illustrated, the plurality of second flow paths 66 further includes a flow path which is surrounded by one of the two sidewalls, one flow path wall of the plurality of second flow path walls 62-1 to 62-*n*, the first bulkhead 45, and the second bulkhead 61, and a flow path which is surrounded by the other of the two sidewalls, one flow path wall of the plurality of second flow path walls 62-1 to 62-*n*, the first bulkhead 45, and the second bulkhead 61. The first flow path 65 and the second flow path 66 form a sinusoidal flow path in which the fluid flows with the flow direction 29 as the traveling direction while repeating vibrations in the span direction 44**.

In this case, a width of the groove 57 formed between the first side flow path wall surface 52 and the second side flow path wall surface 53 is changed depending on a position along the flow path. Accordingly, a cross-sectional area of the first flow path 65 is changed depending on the position along the flow path. Similarly to the first flow path 65, the second flow path 66 also has a different cross-sectional area depending on the position.

The first flow path 65 is formed so that the following Equation (5) is established using a minimum first flow path width Wc1 and a first flow path wall height H1.

$$2.5<Wc1/H1<6 \quad (5)$$

Here, the minimum first flow path width Wc1 is the minimum value of the intervals of the plurality of first flow path walls 48-1 to **48-*n*, and indicates the minimum value of the distances between two adjacent flow path walls among the plurality of first flow path walls 48-1 to 48-*n*, that is, the minimum value of the widths of the first flow path 65. The first flow path wall height H1 indicates the interval between the first bulkhead 45 and the second bulkhead 61, indicates a depth of the first heat exchange flow path recess 26, and indicates heights of the plurality of first flow path walls 48-1 to 48-*n*, that is, a height of the first flow path 65 in the lamination direction 20. The second flow path 66** is formed so that the following Equation (6) is established using a minimum second flow path width Wc2 and a second flow path wall height H2.

$$2.5<Wc2/H2<6 \quad (6)$$

Here, the minimum second flow path width Wc2 is the minimum value of the spaces of the plurality of second flow path walls 62-1 to **62-*n*, and indicates the minimum value of the intervals between two adjacent flow path wall among the plurality of second flow path walls 62-1 to 62-*n*, that is, the minimum value of the widths of the second flow path 66. The second flow path wall height H2 indicates the interval between the first bulkhead 45 and the second bulkhead 61, indicates a depth of the second heat exchange flow path recess 36, and indicates heights of the plurality of second flow path walls 62-1 to 62-*n*, that is, a height of the second flow path 66 in the lamination direction 20. In the bulkhead heat exchanger 1, Wc1/H1 and Wc2/H2 are less than 6. Accordingly, sufficient strength is secured with respect to a pressure of the flowing fluid. Moreover, when the first fluid flows through the plurality of first flow paths 65 and the second fluid flows through the plurality of second flow paths 66, the first bulkhead 45 and the second bulkhead 61 are prevented from being bent by the pressure of each fluid. In the bulkhead heat exchanger 1, Wc1/H1 and Wc2/H2 are larger than 2.5 and smaller than 6. Accordingly, it is possible to suppress a decrease in heat transfer performance of heat transfer between the first fluid and the second fluid, and the first bulkhead 45 and the second bulkhead 61**, and it is possible to suppress a decrease in pressure resistance performance. The design parameters are tuned according to an operating condition of a working fluid.

Moreover, when one of the first fluid and the second fluid is water and the other thereof is a refrigerant (example: R410A, R32), the bulkhead heat exchanger 1 is formed so that a hydraulic diameter of the first flow path 65 is 0.3 mm or less, and a hydraulic diameter of the second flow path 66 is 0.3 mm or less. Further, in this case, the amplitude A of the sine curve to which the first side flow path wall surface 52 and the second side flow path wall surface 53 are smaller than 1.0 mm, and is, for example, 0.6 mm. For example, the period T of the sine curve is 3 mm. The bulkhead heat exchanger 1 is formed in this manner, and thus, the bulkhead heat exchanger 1 can obtain high heat exchange performance between the water and the refrigerant.

[Manufacturing Method of Bulkhead Heat Exchanger 1 of First Embodiment]

Before the bulkhead heat exchanger 1 is manufactured, a plurality of mathematical models of the bulkhead heat exchanger 1 in which the shapes of the plurality of first flow paths 65 and the plurality of second flow paths 66 are different are created. The plurality of mathematical models are used for computer simulation, and are used for calculating a behavior of the fluid flowing through the plurality of first flow paths 65 and the plurality of second flow paths 66 and the heat transfer performance of the heat exchanger. The bulkhead heat exchanger 1 is designed such that the plurality of first flow paths and the plurality of second flow paths are formed to have appropriate shapes based on the behavior of the fluid and the heat transfer performance of the heat exchanger calculated.

In the bulkhead heat exchanger 1, the first side flow path wall surface 52 and the second side flow path wall surface 53 conform to a simple sine curve. Accordingly, it is possible to perform a computer simulation for determining the shapes of the plurality of first flow paths 65 and the plurality of second flow paths 66 with a small number of parameters. As the parameters, the period T, the amplitude A, the offset value $y_0$, and the pitch P are exemplified. In the bulkhead heat exchanger 1, the number of parameters which determine the shapes of the plurality of first flow paths 65 and the plurality of second flow paths 66 decreases. Accordingly, it is possible to decrease an amount of calculation of the computer when executing the computer simulation, and it is possible to shorten a time required for computer simulation. Therefore, in the bulkhead heat exchanger 1, it is possible to easily perform an operation for optimizing the shapes of the plurality of first flow path walls 48-1 to **48-*n* and the plurality of second flow path walls 62-1 to 62-*n*** by computer simulation.

The first heat exchanger plate 21 and the second heat exchanger plate 31 are manufactured by etching a metal plate. For example, a thickness of the metal plate is 0.3 mm. For example, the plurality of heat exchanger plates are joined to each other together with the first end plate 11 and the second end plate 12 by diffusion joining. In this case, the first inflow chamber hole 22 of the first heat exchanger plate 21 and the first inflow chamber hole 32 of the second heat exchanger plate 31 are connected to each other to form the first inflow chamber 14 by joining the first end plate 11, the second end plate 12, and the plurality of heat exchanger plates to each other. Furthermore, the first outflow chamber hole 23 of the first heat exchanger plate 21 and the first outflow chamber hole 33 of the second heat exchanger plate 31 form the first outflow chamber 15. The second inflow chamber hole 24 of the first heat exchanger plate 21 and the second inflow chamber hole 34 of the second heat exchanger plate 31 form the second inflow chamber 16. The second outflow chamber hole 25 of the first heat exchanger plate 21 and the second outflow chamber hole 35 of the second heat exchanger plate 31 form the second outflow chamber 17.

The first outflow hole 18, the second outflow hole 19, the first inflow hole, and the second inflow hole are formed by machining after the first end plate 11, the second end plate 12, and the plurality of laminated heat exchanger plates are joined to each other. For example, the first inflow pipe 5, the first outflow pipe 6, the second inflow pipe 7, and the second outflow pipe 8 are fixed to the heat exchanger body 2 by welding after being respectively inserted into the first inflow hole, the first outflow hole 18, the second inflow hole, and the second outflow hole 19.

[Operation of Bulkhead Heat Exchanger 1 of First Embodiment]

In the bulkhead heat exchanger 1, the first fluid flows into the first inflow chamber 14 via the first inflow pipe 5. After the first fluid flows into the first inflow chamber 14, the first fluid is distributed to the plurality of first heat exchanger plates 21 and flows into the first inflow flow path recesses 27 formed in the first heat exchanger plate 21. After the first fluid flows into the first inflow flow path recess 27, a width of the first fluid flowing through the first inflow flow path recess 27 is expanded from the width of the first inflow chamber 14 to the width of the first heat exchange flow path recess 26, and thus, the first fluid flows into the plurality of first flow paths 65 formed in the first heat exchange flow path recess 26. When the first fluid flows through the plurality of first flow paths 65, the first side flow path wall surface 52 and the second side flow path wall surface 53 conform to the sine curve, and thus, the flow direction of the first fluid is changed in a sinusoidal manner. In a portion of the plurality of first flow path walls 48-1 to **48-*n* overlapping the maximum point or the minimum point of the sine curve, the flow direction of the first fluid is sharply changed compared to the other portions, and thus, the portion receives a large stress from the first fluid. In the portion of the plurality of first flow path walls 48-1 to 48-*n*** overlapping the maximum point or the minimum point of the sine curve, the width of the flow path wall is largely formed compared to the other portions. As a result, strength with respect to the stress received from the first fluid is higher than those of the other portions, and it is possible to secure sufficient strength with respect to the larger stress as compared to the other portions.

When the first fluid flows through the plurality of first flow paths 65, the cross-sectional areas of the plurality of first flow paths 65 are changed depending on the positions in the flow direction along the flow paths, and thus, a flow speed of the first fluid is changed. When the first fluid flows through the plurality of first flow paths 65, the flow direction is changed in a sinusoidal manner and the flow speed is changed, and thus, the first fluid is always disturbed locally. In the bulkhead heat exchanger 1, the first fluid is always disturbed locally. Therefore, it is possible to reduce a thermal resistance of heat transfer between the first fluid and the first bulkhead 45 and reduce a thermal resistance of heat transfer between the first fluid and the second bulkhead 61.

Moreover, in the bulkhead heat exchanger 1, the second fluid flows into the second inflow chamber 16 via the second inflow pipe 7. After the second fluid flows into the second inflow chamber 16, the second fluid is distributed to the plurality of second heat exchanger plates 31 and flows into the second inflow flow path recesses 37 formed in the second heat exchanger plate 31. After the second fluid flows into the second inflow flow path recess 37, a width of the second fluid flowing through the second inflow flow path recess 37 is expanded from the width of the second inflow chamber 16 to the width of the second heat exchange flow path recess 36, and thus, the second fluid flows into the plurality of second flow paths 66 formed in the second heat exchange flow path recess 36. In this case, while the first fluid as a whole flows from the first inflow chamber 14 toward the first outflow chamber 15 as the flow direction 29, the second fluid as a whole flows in a direction opposite to the flow direction of the first fluid from the first outflow chamber 15 side toward the first inflow chamber 14 side as the flow direction 29. That is, the bulkhead heat exchanger 1 is a so-called countercurrent heat exchanger.

When the second fluid flows through the plurality of second flow paths 66, the first side flow path wall surface 52 and the second side flow path wall surface 53 conform to the sine curve, and thus, the flow direction of the second fluid is changed in a sinusoidal manner. In a portion of the plurality of second flow path walls 62-1 to **62-*n* overlapping the maximum point or the minimum point of the sine curve, the flow direction of the second fluid is sharply changed compared to the other portions, and thus, the portion receives a large stress from the second fluid. In the portion of the plurality of second flow path walls 62-1 to 62-*n*** overlapping the maximum point or the minimum point of the sine curve, the width of the flow path wall is largely formed compared to the other portions. As a result, strength with respect to the stress received from the second fluid is higher than those of the other portions, and it is possible to secure sufficient strength with respect to the larger stress as compared to the other portions.

When the second fluid flows through the plurality of second flow paths 66, the cross-sectional areas of the plurality of second flow paths 66 are changed depending on the positions in the flow direction along the flow paths, and thus, a flow speed of the second fluid is changed. When the second fluid flows through the plurality of second flow paths 66, the flow direction is changed in a sinusoidal manner and the flow speed is changed, and thus, the second fluid is always disturbed locally. In the bulkhead heat exchanger 1, the second fluid is always disturbed locally. Therefore, it is possible to reduce a thermal resistance of heat transfer between the second fluid and the first bulkhead 45 and reduce a thermal resistance of heat transfer between the second fluid and the second bulkhead 61. In the bulkhead heat exchanger 1, the thermal resistance of heat transfer between the first fluid and the second fluid, and the first bulkhead 45 and the second bulkhead 61 is reduced. Accordingly, it is possible to improve performance of the heat exchange performed between the first fluid and the second fluid.

The first fluid flows into the first outflow flow path recesses 28 after flowing through the plurality of first flow paths 65. After the first fluid flows into the first outflow flow path recess 28, the width of the first fluid flowing through the first outflow flow path recess 28 is narrowed from the width of the first heat exchange flow path recess 26 to the width of the first outflow chamber 15, and the first fluid flows into the first outflow chamber 15. The first fluids which flow into the first outflow chamber 15 from the plurality of first heat exchanger plates 21 via the first outflow flow path recesses 28 are combined in the first outflow chamber 15. The first fluid combined in the first outflow chamber 15 flows out to the outside via the first outflow pipe 6. The second fluid flows into the second outflow flow path recess 38 after flowing through the plurality of second flow paths 66. After the second fluid flows into the second outflow flow path recess 38, the width of the second fluid flowing through the second outflow flow path recess 38 is narrowed from the width of the second heat exchange flow path recess 36 to the width of the second outflow chamber 17, and the second fluid flows into the second outflow chamber 17. The second fluid supplied from the plurality of second heat exchanger plates 31 via the second outflow flow path recess 38 is combined in the second outflow chamber 17. The second fluid combined in the second outflow chamber 17 flows out to the outside via the second outflow pipe 8.

[Effect of Bulkhead Heat Exchanger 1 of First Embodiment]

The bulkhead heat exchanger 1 of the first embodiment includes the first bulkhead 45 (corresponding to the "first bulkhead"), the second bulkhead 61 (corresponding to the "second bulkhead"), and the plurality of first flow path walls 48-1 to **48-*n*. The plurality of first flow path walls 48-1 to 48-*n* divide the first space 67 inside the first heat exchange flow path recess 26 formed between the first bulkhead 45 and the second bulkhead 61 into the plurality of first flow paths 65. In this case, the first bulkhead 45 and the second bulkhead 61 separate the plurality of first flow paths 65 from the plurality of second flow paths 66 through which the second fluid different from the first fluid flowing through the plurality of first flow paths 65 flows. Each of the plurality of first flow path walls 48-1 to 48-*n* is formed so as to conform to a sine curve. Further, the plurality of first flow path walls 48-1 to 48-*n* form the plurality of first side flow path wall surfaces 52 and the plurality of second side flow path wall surfaces 53** conforming to sine curves different from each other.

In the bulkhead heat exchanger 1, the plurality of first side flow path wall surfaces 52 and the plurality of second side flow path wall surface 53 conforming to the sine curves are formed. Accordingly, the flow direction of the first fluid flowing through the plurality of first flow paths 65 can be changed in a sinusoidal manner. In the bulkhead heat exchanger 1, the plurality of first side flow path wall surfaces 52 and the plurality of second side flow path wall surfaces 53 conforming to the sine curve are formed. Accordingly, the widths of the plurality of first flow paths 65 can be changed along the direction in which the first fluid flows. In the bulkhead heat exchanger 1, the widths of the plurality of first flow paths 65 are changed. Accordingly, it is possible to change the cross-sectional areas of the plurality of first flow paths 65, and it is possible to change the speed of the first fluid flowing through the plurality of first flow paths 65. In the bulkhead heat exchanger 1, the flow direction of the first fluid is changed and the speed of the first fluid is changed. Accordingly, it is possible to always disturb locally the first fluid flowing through the plurality of first flow paths 65. In the bulkhead heat exchanger 1, the first fluid flowing through the plurality of first flow paths 65 is always disturbed locally. Accordingly, it is possible to reduce the thermal resistance of heat transfer between the first fluid and the first bulkhead 45 and reduce the thermal resistance in heat transfer between the first fluid and the second bulkhead 61. In the bulkhead heat exchanger 1, the thermal resistance is reduced. Accordingly, it is possible to improve the heat transfer performance when performing heat exchange between the first fluid and the second fluid flowing through the plurality of second flow paths 66. In the bulkhead heat exchanger 1, the plurality of first side flow path wall surfaces 52 and the plurality of second side flow path wall surfaces 53 conform to simple sine curves, respectively. Accordingly, when computer simulation of the behavior of the first fluid is performed, it is possible to easily input and change the shapes of the plurality of first flow paths 65 and reduce a calculation load on the computer. As a result, in the bulkhead heat exchanger 1, it is possible to easily perform the operation of optimizing the shapes of the plurality of first flow path walls 48-1 to **48-*n***.

Further, the bulkhead heat exchanger 1 of the first embodiment further includes the first sidewall 46 in which the first sidewall surface 41 formed at the end of the first space 67 inside the first heat exchange flow path recess 26 is formed. In this case, the first sidewall surface 41 is formed so as to conform to the same sine curve as the sine curve to which the plurality of first side flow path wall surfaces 52 and the plurality of second side flow path wall surfaces 53 conform. That is, the period of the sine curve to which the first sidewall surface 41 conforms is equal to the period of the sine curve to which the plurality of first side flow path wall surfaces 52 and the plurality of second side flow path wall surfaces 53 conform, and the amplitude of the sine curve to which the first sidewall surface 41 conforms is equal to the amplitude of the sine curve to which the plurality of first side flow path wall surfaces 52 and the plurality of second side flow path wall surfaces 53 conform.

In the bulkhead heat exchanger 1, similarly to the first fluid flowing through the flow path interposed between the plurality of first flow path walls 48-1 to **48-*n*, it is possible to always disturb locally the first fluid flowing through the flow path formed between the flow path wall 48-1 and the first sidewall surface 41. As a result, in the bulkhead heat exchanger 1**, the first fluid is always disturbed locally, and thus, it is possible to further improve the heat transfer performance when the heat exchange is performed between the first fluid and the second fluid.

Further, in the bulkhead heat exchanger 1 of the first embodiment, the value Wc1/H1 obtained by dividing the minimum first flow path width Wc1 which is the minimum value of the intervals between the plurality of first flow path walls 48-1 to **48-*n* by the first flow path wall height H1 which is the interval between the first bulkhead 45 and the second bulkhead 61 is larger than 2.5 and smaller than 6. In the bulkhead heat exchanger 1, since Wc1/H1 is smaller than 6, the strength of the first bulkhead 45 and the second bulkhead 61 is secured, and the first bulkhead 45 and the second bulkhead 61 are prevented from being bent by the pressure of the fluid when the first fluid flows through the plurality of first flow paths 65. In the bulkhead heat exchanger 1, Wc1/H1 is larger than 2.5 and is smaller than 6. Accordingly, it is possible to suppress a decrease in heat transfer performance between the first fluid and the first bulkhead 45 and the second bulkhead 61, and it is possible to suppress a decrease in pressure resistance performance. Moreover, the second flow path walls 62-1 to 62-*n* are also formed similarly to the plurality of first flow path walls 48-1 to 48-*n*. Accordingly, in the bulkhead heat exchanger 1, it is possible to suppress a decrease in heat transfer performance between the second fluid and the first bulkhead 45 and the second bulkhead 61, and it is possible to secure the strength of the first bulkhead 45 and the second bulkhead 61**.

Second Embodiment

Figure 8:
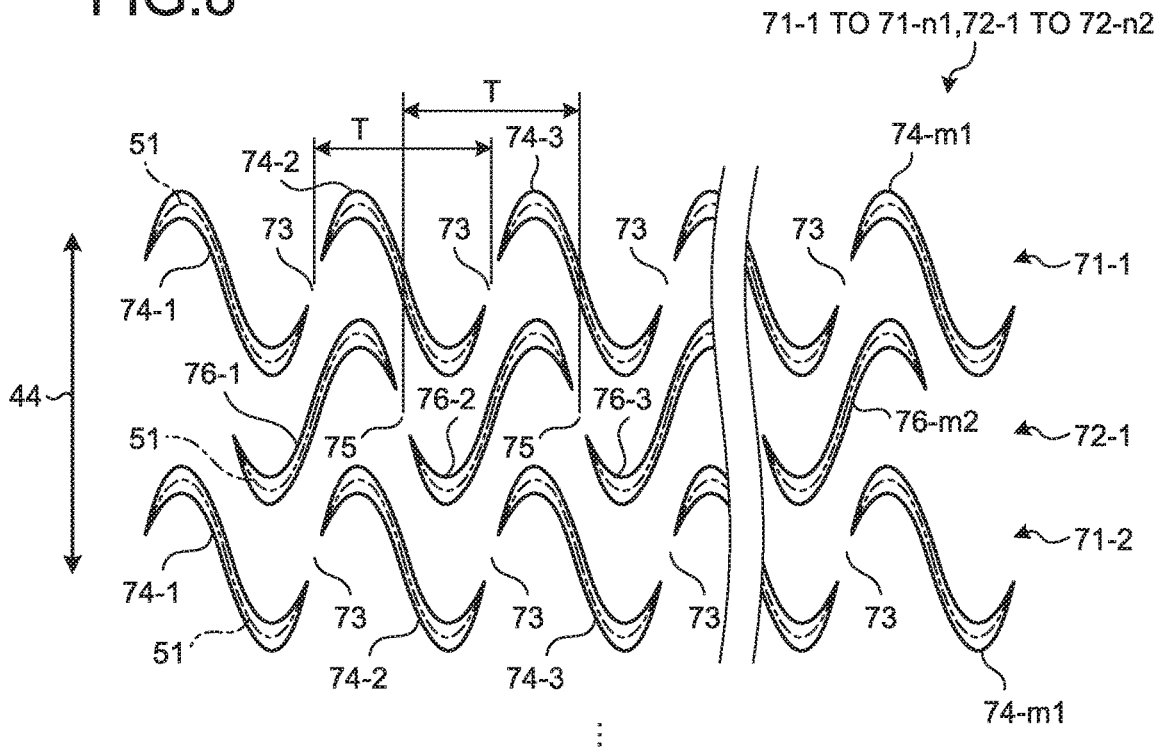
FIG. 8 is a plan view illustrating a plurality of odd-numbered flow path walls and a plurality of even-numbered flow path walls which are formed in a bulkhead heat exchanger of a second embodiment.

As illustrated in FIG. 8, in a bulkhead heat exchanger of a second embodiment, the plurality of first flow path walls 48-1 to **48-*n* of the bulkhead heat exchanger 1 of the first embodiment described above are replaced with a plurality of odd-numbered flow path walls 71-1 to 71-*n*1 (n1 is a positive integer and the same applies hereinafter) and a plurality of even-numbered flow path walls 72-1 to 72-*n*2 (n2 is a positive integer and the same applies hereinafter). FIG. 8 is a plan view illustrating the plurality of odd-numbered flow path walls 71-1 to 71-*n*1 and the plurality of even-numbered flow path walls 72-1 to 72-*n*2 formed in the bulkhead heat exchanger of the second embodiment. Similarly to the first flow path wall 48-1 described above, one odd-numbered flow path wall 71-1 of the plurality of odd-numbered flow path walls 71-1 to 71-*n*1 conforms to a sine curve 51. The other odd-numbered flow path walls different from the odd-numbered flow path wall 71-1 among the plurality of odd-numbered flow path walls 71-1 to 71-*n*1 are also formed so as to conforms to the sine curve 51, similarly to the odd-numbered flow path wall 71-1. Similarly to the first flow path wall 48-2 described above, one even-numbered flow path wall 72-1 of the plurality of even-numbered flow path walls 72-1 to 72-*n*2 conforms to the sine curve 51. The other even-numbered flow path walls different from the even-numbered flow path wall 72-1 among the plurality of even-numbered flow path walls 72-1 to 72-*n*2 are also formed so as to conforms to the sine curve 51, similarly to the even-numbered flow path wall 72-1. One even-numbered flow path wall of the plurality of even-numbered flow path walls 72-1 to 72-*n*2 is disposed between two adjacent odd-numbered flow path walls among the plurality of odd-numbered flow path walls 71-1 to 71-*n*1. One odd-numbered flow path wall of the plurality of odd-numbered flow path walls 71-1 to 71-*n*1 is disposed between two adjacent even-numbered flow path walls among the plurality of even-numbered flow path walls 72-1 to 72-*n*2. That is, the plurality of odd-numbered flow path walls 71-1 to 71-*n*1 and the plurality of even-numbered flow path walls 72-1 to 72-*n*2 are alternately arranged in the span direction 44**.

The odd-numbered flow path wall 71-1 is formed by removing a plurality of portions from the first flow path wall 48-1 to form a plurality of odd-numbered notches 73, and is divided into a plurality of odd-numbered flow path wall elements 74-1 to **74-*m*1 (m1 is a positive integer and the same applies hereinafter). The plurality of odd-numbered notches 73 are periodically formed in the odd-numbered flow path wall 71-1 at each period T. In the other odd-numbered flow path walls different from the odd-numbered flow path wall 71-1 among the plurality of odd-numbered flow path walls 71-1 to 71-*n*1 as well, similarly to the odd-numbered flow path wall 71-1, the plurality of odd-numbered notches 73 are formed and divided into a plurality of odd-numbered flow path wall elements 74-1 to 74-*m*1. The even-numbered flow path wall 72-1 is formed by removing a plurality of portions from the first flow path wall 48-2 to form a plurality of even-numbered notches 75, and is divided into a plurality of even-numbered flow path wall elements 76-1 to 76-*m*2 (m2 is a positive integer and the same applies hereinafter). The "notches" indicate both the plurality of odd-numbered notches 73 and the plurality of even-numbered notches 75. The plurality of even-numbered notches 75 are periodically formed in the even-numbered flow path wall 72-1 at each period T. In the other even-numbered flow path walls different from the even-numbered flow path wall 72-1 among the plurality of even-numbered flow path walls 72-1 to 72-*n*2 as well, similarly to the even-numbered flow path wall 72-1, the plurality of even-numbered notches 75 are formed and divided into a plurality of even-numbered flow path wall elements 76-1 to 76-*m*2**.

Figure 9:
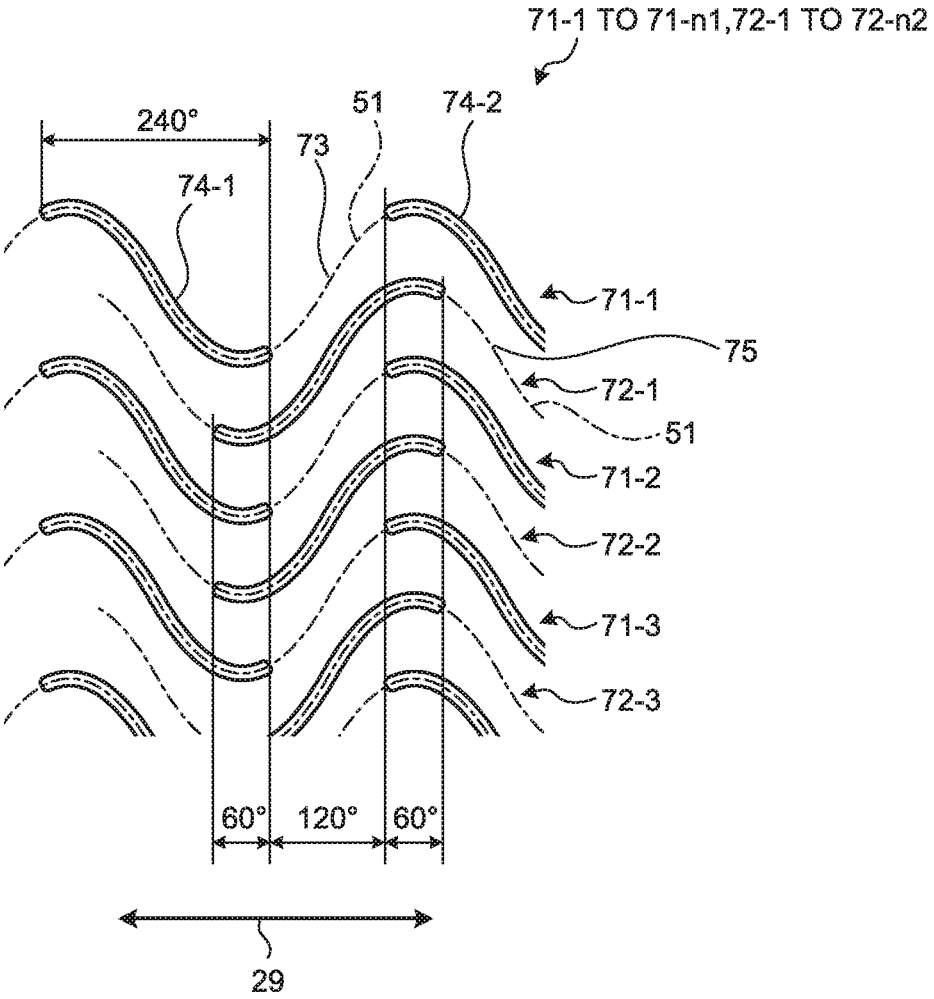
FIG. 9 is an explanatory view schematically illustrating the plurality of odd-numbered flow path walls and the plurality of even-numbered flow path walls which are formed in the bulkhead heat exchanger of the second embodiment.

FIG. 9 is an explanatory view for schematically illustrating the plurality of odd-numbered flow path walls 71-1 to **71-*n*1 and the plurality of even-numbered flow path walls 72-1 to 72-*n*2 formed in the bulkhead heat exchanger of the second embodiment. As illustrated in FIG. 9, one odd-numbered flow path wall element 74-1 of the plurality of odd-numbered flow path wall elements 74-1 to 74-*m*1 of the odd-numbered flow path wall 71-1 is formed so as to overlap a portion of the sine curve 51 to which the odd-numbered flow path wall 71-1 conforms in which a phase thereof corresponds to a range of 240° from $\pi/3$ to $5\pi/3$. That is, the odd-numbered flow path wall element 74-1 is formed so as to overlap a portion of the sine curve 51 where the phase is $\pi/2$ and a portion of the sine curve 51 where the phase is $3\pi/2$, and is formed so as to overlap a portion corresponding to each of the maximum point and the minimum point of the sine curve 51. In the other odd-numbered flow path wall elements different from the odd-numbered flow path wall element 74-1 of the plurality of odd-numbered flow path wall elements 74-1 to 74-*m*1 as well, similarly to the odd-numbered flow path wall element 74-1, the other odd-numbered flow path wall elements are formed so as to overlap a portion of the sine curve 51 to which the odd-numbered flow path wall 71-1** conforms in which a phase thereof corresponds to a range of 240° from $\pi/3+2\pi i$ to $5\pi/3+2\pi i$ using an integer i.

One odd-numbered notch of the plurality of odd-numbered notches 73 is formed by removing a portion of the sine curve 51 in which the phase corresponds to a range of 120° from $5\pi/3$ to $7\pi/3$. The odd-numbered notch 73 formed in this way includes a portion of the sine curve 51 having a phase of $2\pi$, that is, includes an inflection point of the sine curve 51. Similarly, in the other notches of the plurality of odd-numbered notches 73 as well, the other notches are formed so as to include a portion of the sine curve 51 having a phase of 2πi and to overlap the inflection point of the sine curve 51. That is, in the plurality of odd-numbered flow path walls 71-1, the plurality of odd-numbered notches 73 are formed so that the plurality of odd-numbered flow path wall elements 74-1 to **74-*m*1 do not overlap the inflection point where the phase of the sine curve 51 is 2πi. Of the plurality of odd-numbered flow path walls 71-1 to 71-*n*1, the other odd-numbered flow path walls different from the odd-numbered flow path wall 71-1 are also formed similarly to the odd-numbered flow path wall 71-1**.

One even-numbered flow path wall element 76-1 of the plurality of even-numbered flow path wall elements 76-1 to **76-*m*2 of the even-numbered flow path wall 72-1 is formed so as to overlap a portion of the sine curve 51 in which a phase corresponds to a range of 240° from 4π/3 to 8π/3. That is, the even-numbered flow path wall element 76-1 is formed so as to overlap a portion of the sine curve 51 in which the phase is 3π/2 and a portion of the sine curve 51 in which the phase is 5π/2, and is formed so as to overlap a portion corresponding to each of the maximum point and the minimum point of the sine curve 51. In the other even-numbered flow path wall elements different from the even-numbered flow path wall element 76-1 of the plurality of even-numbered flow path wall elements 76-1 to 76-*m*2 as well, similarly to the even-numbered flow path wall element 76-1, the other even-numbered flow path wall elements are formed so as to overlap a portion of the sine curve 51 to which the even-numbered flow path wall 72-1** conforms in which a phase thereof corresponds to a range of 240° from 4π/3+2πi to 8π/3+2πi.

One notch of the plurality of even-numbered notches 75 is formed by removing a portion of the sine curve 51 in which the phase corresponds to a range of 120° from 2π/3 to 4π/3. The notch formed in this way includes a portion of the sine curve 51 having a phase of π, that is, includes the inflection point of the sine curve 51. Similarly, in the other notches of the plurality of even-numbered notches 75 as well, the other notches are formed so as to include a portion of the sine curve 51 in which the phase corresponds to a range of 120° from 2π/3+2πi to 4π/3+2πi and to overlap the inflection point of the sine curve 51. That is, in the plurality of even-numbered flow path walls 72-1, the plurality of even-numbered notches 75 are formed so that the plurality of even-numbered flow path wall elements 76-1 to **76-*m*2 do not overlap the inflection point where the phase of the sine curve 51 is n+2πi. Of the plurality of even-numbered flow path walls 72-1 to 72-*n*2, the other even-numbered flow path walls different from the even-numbered flow path wall 72-1 are also formed similarly to the even-numbered flow path wall 72-1**.

Figure 10:
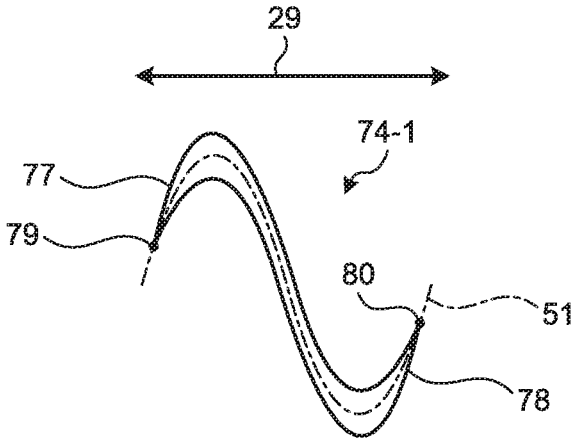
FIG. 10 is a plan view illustrating an odd-numbered flow path wall element.

FIG. 10 is a plan view illustrating an example of the odd-numbered flow path wall element 74-1. As illustrated in FIG. 10, the odd-numbered flow path wall element 74-1 includes a head 77 and a tail 78. The head 77 forms one end 79 (corresponding to an "end adjacent to the notch") of the odd-numbered flow path wall element 74-1 in the flow direction 29 and is adjacent to one odd-numbered notch 73. The head 77 is formed so as to be tapered toward the one end 79 of the odd-numbered flow path wall element 74-1. That is, the head 77 is formed so that a width thereof is gently reduced toward the one end 79 of the odd-numbered flow path wall element 74-1. The tail 78 forms the other end 80 (corresponding to an "end adjacent to the notch") of the odd-numbered flow path wall element 74-1 opposite to the one end 79 where the head 77 is formed, and is adjacent to one odd-numbered notch 73. The tail 78 is formed so as to be tapered toward the other end 80 of the odd-numbered flow path wall element 74-1 in the flow direction 29, that is, the tail 78 is formed so that a width thereof is gently reduced toward the other end 80 of the odd-numbered flow path wall element 74-1. The other flow path wall elements different from the odd-numbered flow path wall element 74-1 of the plurality of odd-numbered flow path wall elements 74-1 to **74-*m*1 are also formed similarly to the odd-numbered flow path wall element 74-1**.

The plurality of even-numbered flow path wall elements 76-1 to **76-*m*2 are formed similarly to the plurality of odd-numbered flow path wall elements 74-1 to 74-*m*1, and each of the plurality of even-numbered flow path wall elements 76-1 to 76-*m*2 is formed of a flow path wall element which is mirror image symmetric to the odd-numbered flow path wall element 74-1. Thereby, for example, a portion in which end portions of the odd-numbered flow path wall element and the even-numbered flow path wall element adjacent to each other in the span direction 44 overlap each other in the span direction is formed. In FIG. 9, this overlapping portion is a portion in which the phase of each of the end portions of the even-numbered flow path wall element and the odd-numbered flow path wall element is in a range of 60°. Further, the second heat exchanger plate of the bulkhead heat exchanger of the second embodiment is formed by replacing the plurality of second flow path walls 62-1 to 62-*n* of the second heat exchanger plate 31 of the bulkhead heat exchanger 1 of the first embodiment with those similar to the plurality of odd-numbered flow path walls 71-1 to 71-*n*1 and the plurality of even-numbered flow path walls 72-1 to 72-*n*2**.

Similarly to the bulkhead heat exchanger 1 of the first embodiment described above, in the bulkhead heat exchanger of the second embodiment, the first fluid flows through the plurality of first flow paths, the second fluid flows through the plurality of second flow paths, and heat exchange is performed between the first fluid and the second fluid. Similarly to the bulkhead heat exchanger 1 of the first embodiment described above, in the bulkhead heat exchanger of the second embodiment, the first fluid and the second fluid can be always disturbed locally, and it is possible to improve heat transfer performance in heat exchange between the first fluid and the second fluid. In the bulkhead heat exchanger of the second embodiment, wall surfaces of the plurality of odd-numbered flow path walls 71-1 to **71-*n*1 and the plurality of even-numbered flow path walls 72-1 to 72-*n*2 conform to a sine curve. Accordingly, similarly to the bulkhead heat exchanger 1 of the first embodiment described above, it is possible to easily perform an operation of optimizing shapes of the plurality of odd-numbered flow path walls 71-1 to 71-*n*1 and the plurality of even-numbered flow path walls 72-1 to 72-*n*2**.

In the bulkhead heat exchanger of the second embodiment, the plurality of odd-numbered notches 73 and the plurality of even-numbered notches 75 are formed. Accordingly, compared to the bulkhead heat exchanger of the first embodiment described above, a frictional resistance when the first fluid flows through the plurality of first flow paths is reduced, and as a result, a pressure loss is reduced. In the bulkhead heat exchanger, the plurality of odd-numbered notches 73 and the plurality of even-numbered notches 75 are formed. Accordingly, a so-called leading edge effect is generated, and compared to the bulkhead heat exchanger of the first embodiment described above, the heat transfer coefficient between the first fluid, and the first bulkhead 45 and the second bulkhead 61 can be improved. A sinusoidal flow of the fluid is mainly generated in the plurality of odd-numbered flow path wall elements 74-1 to **74-*m*1 and the plurality of even-numbered flow path wall elements 76-1 to 76-*m*2 which are portions having a large centrifugal force acting on the flowing fluid before and after a portion overlapping the maximum point or the minimum point of the sine curve 51 of the flow path wall. Therefore, even if the plurality of odd-numbered notches 73 and the plurality of even-numbered notches 75 are formed by removing the portion of the sine curve 51** which overlaps the inflection point and has a small centrifugal force acting on the flowing fluid, the sinusoidal flow is not disturbed. The notches are provided, and thus, it is possible to reduce the frictional resistance caused by the flow path wall when the fluid flows through the flow path while maintaining the sinusoidal flow.

[Effect of Bulkhead Heat Exchanger of Second Embodiment]

The plurality of notches are formed at each period of the sine curve, and thus, each of the plurality of flow path walls of the bulkhead heat exchanger of the second embodiment is divided into the plurality of flow path wall elements. The plurality of notches illustrate both the plurality of odd-numbered notches 73 and the plurality of even-numbered notches 75. That is, the plurality of odd-numbered notches 73 are formed at each period of the sine curve, each of the plurality of odd-numbered flow path walls 71-1 to **71-*n*1 is divided into the plurality of odd-numbered flow path wall elements 74-1 to 74-*m*1. In this case, the plurality of odd-numbered notches 73 overlap the inflection points of the sine curve 51. The maximum point and the minimum point of the sine curve 51 overlap the wall surfaces formed in the plurality of odd-numbered flow path wall elements 74-1 to 74-*m*, respectively. The plurality of even-numbered notches 75 are formed at each period of the sine curve. Accordingly, each of the plurality of even-numbered flow path walls 72-1 to 72-*n*2 is divided into the plurality of even-numbered flow path wall elements 76-1 to 76-*m*2. In this case, the plurality of even-numbered notches 75 overlap the inflection points of the sine curve 51. The maximum point and the minimum point of the sine curve 51 overlap the wall surfaces formed in the plurality of even-numbered flow path wall elements 76-1 to 76-*m*2**, respectively.

In the bulkhead heat exchanger, the plurality of odd-numbered notches 73 are formed in the plurality of odd-numbered flow path walls 71-1 to **71-*n*1. Accordingly, it is possible to reduce the frictional force received from the plurality of odd-numbered flow path walls 71-1 to 71-*n*1 when the first fluid flows. In the bulkhead heat exchanger of the second embodiment, the frictional force acting between the plurality of odd-numbered flow path walls 71-1 to 71-*n*1 and the first fluid is reduced. Accordingly, it is possible to reduce flow resistances of the plurality of first flow paths formed between the plurality of odd-numbered flow path walls 71-1 to 71-*n*1. In the bulkhead heat exchanger 1 of the second embodiment, the plurality of odd-numbered flow path wall elements 74-1 to 74-*m*1 are formed. Accordingly, an opportunity of the working fluid coming into contact with the head 77 and the tail 78 becoming an edge (end adjacent to the notch) of the flow path wall element is provided, a so-called leading edge effect is generated, and thus, it is possible to improve the heat transfer coefficient between the first fluid, and the first bulkhead 45 and the second bulkhead 61**.

Moreover, the plurality of odd-numbered flow path wall elements 74-1 to **74-*m*1 of the bulkhead heat exchanger of the second embodiment are formed so that the widths thereof are gently reduced toward the end. In the bulkhead heat exchanger, the widths of the head 77 and the tail 78 of each of the plurality of odd-numbered flow path wall elements 74-1 to 74-*m*1 are gently reduced toward the ends. Accordingly, it is possible to reduce shape losses caused by the plurality of odd-numbered flow path wall elements 74-1 to 74-*m*1** when the first fluid flows.

Further, in the plurality of odd-numbered flow path wall elements 74-1 to 74- m1 and the plurality of even-numbered flow path wall elements 76-1 to **76-*m*2 of the bulkhead heat exchanger of the second embodiment, the portion in which the end portions adjacent to each other in the span direction 44 overlap each other in the span direction 44 is formed. As a result, the width of the flow path which does not have the overlapping portion is wide, the width of the flow path which has the overlapping portion is narrow, and a change in the width of the flow path is periodically repeated. This periodic change in the width of the flow path generates a periodic disturbance to the fluid flowing through the flow path, and compared to the bulkhead heat exchanger of the first embodiment described above, it is possible to improve the heat transfer coefficient between the first fluid, and the first bulkhead 45 and the second bulkhead 61. As a result, compared to the bulkhead heat exchanger of the first embodiment described above, the local constant disturbance of the fluid caused by the periodic changes of the widths of the flow path walls 71-1 to 71-*n*1 and 72-1 to 72-*n*2 and the leading edge effect caused by the flow path wall elements 74-1 to 74-*m*1 and 76-1 to 76-*m*2 formed by providing the notches 73 and 75** are combined with each other, and thus, it is possible to further improve the heat transfer performance.

Third Embodiment

Figure 11:
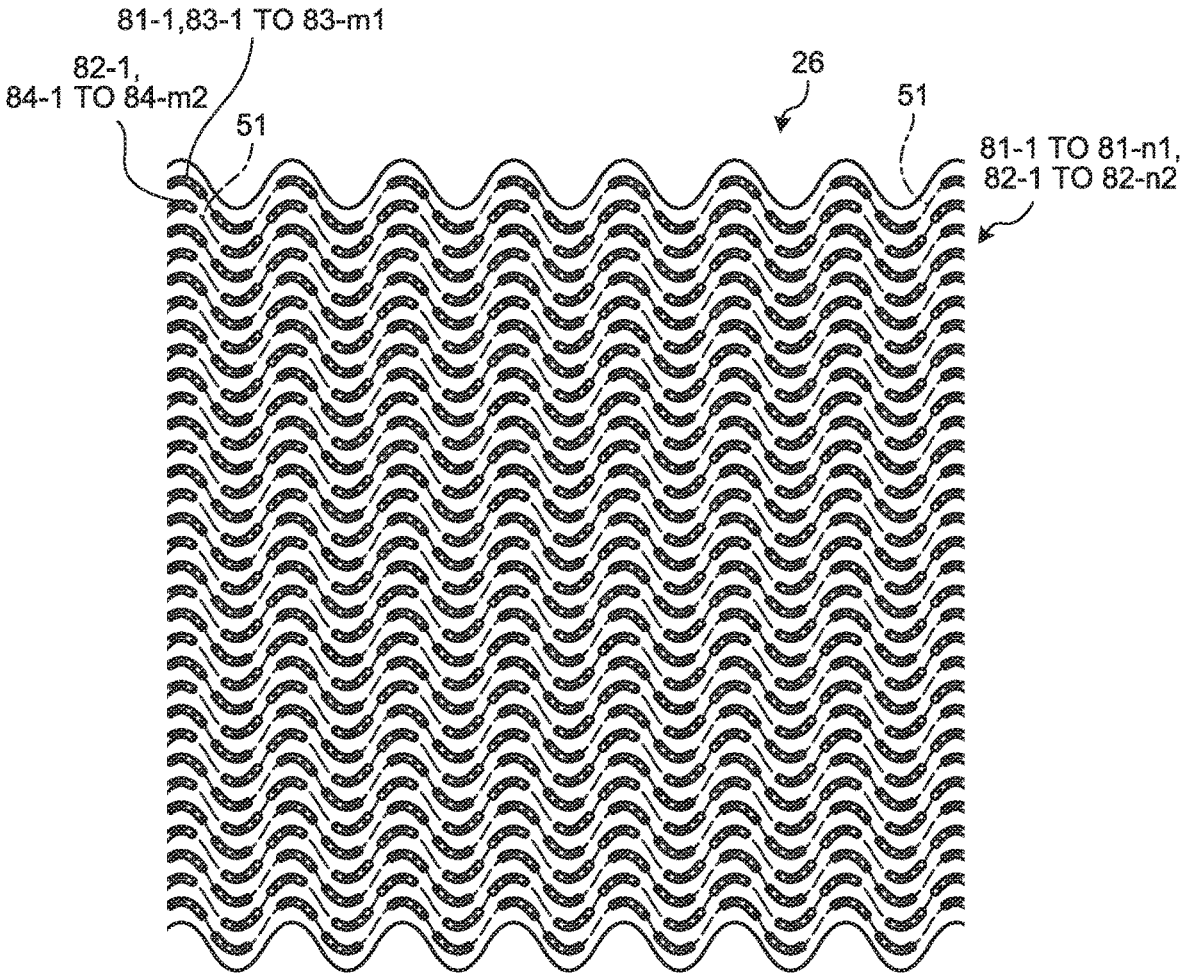
FIG. 11 is a plan view illustrating a plurality of odd-numbered flow path walls which are formed in a bulkhead heat exchanger of a third embodiment.

As illustrated in FIG. 11, in a bulkhead heat exchanger of a third embodiment, the plurality of odd-numbered flow path walls 71-1 to **71-*n*1 of the bulkhead heat exchanger of the second embodiment described above are replaced with a plurality of other odd-numbered flow path walls 81-1 to 81-*n*1, and the plurality of even-numbered flow path walls 72-1 to 72-*n*2 are replaced with a plurality of other even-numbered flow path walls 82-1 to 82-*n*2. FIG. 11 is a plan view illustrating the plurality of odd-numbered flow path walls 81-1 to 81-*n*1 and the plurality of even-numbered flow path walls 82-1 to 82-*n*2 formed in the bulkhead heat exchanger of the third embodiment. Similarly to the plurality of odd-numbered flow path walls 71-1 to 71-*n*1 and the plurality of even-numbered flow path walls 72-1 to 72-*n*2 described above, the plurality of odd-numbered flow path walls 81-1 to 81-*n*1 and the plurality of even-numbered flow path walls 82-1 to 82-*n*2 are formed in the first heat exchange flow path recess 26, and one of each of which is formed so as to overlap one of the plurality of sine curves 51 disposed at a predetermined pitch P in the span direction 44. Similarly to the odd-numbered flow path wall 71-1 described above, in one odd-numbered flow path wall 81-1 of the plurality of odd-numbered flow path walls 81-1 to 81-*n*1, a plurality of odd-numbered notches 73 are formed, and thus, one odd-numbered flow path wall 81-1 is divided into a plurality of odd-numbered flow path wall elements 83-1 to 83-*m*1. Similarly to the even-numbered flow path wall 72-1 described above, in one even-numbered flow path wall 82-1 of the plurality of even-numbered flow path walls 82-1 to 82-*n*2, a plurality of even-numbered notches 75 are formed, and thus, one even-numbered flow path wall 82-1 is divided into a plurality of even-numbered flow path wall elements 84-1 to 84-*m*2**.

Figure 12:
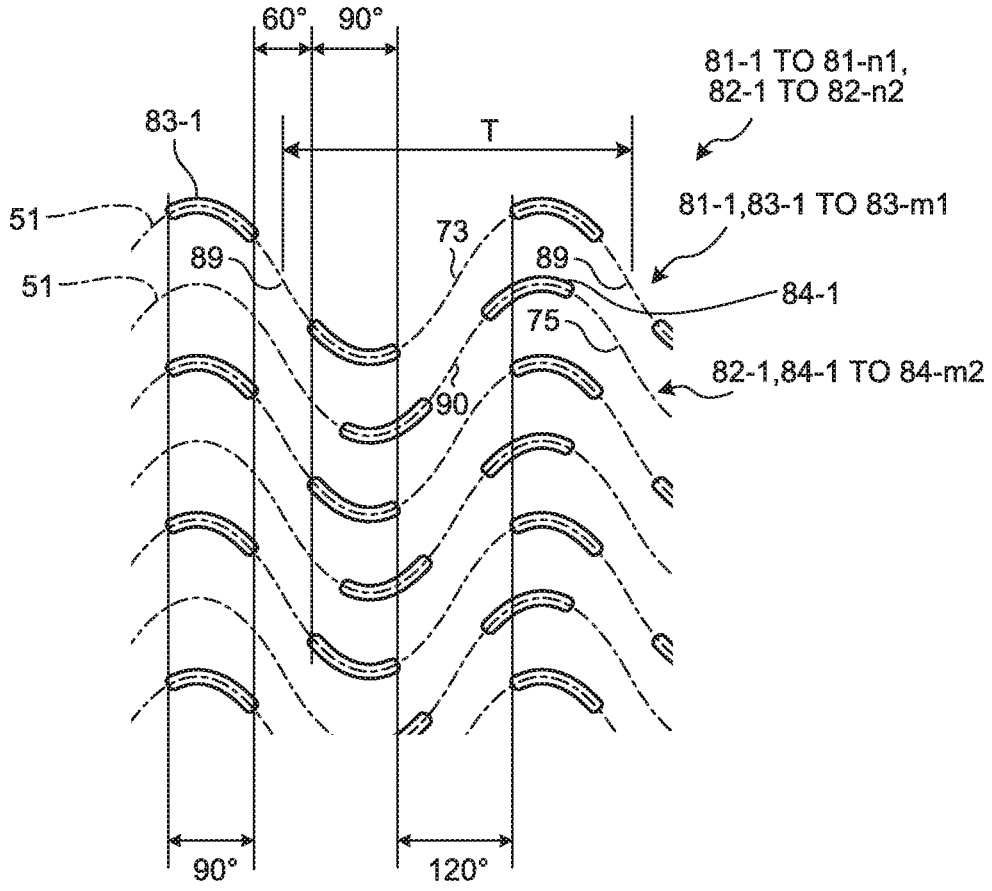
FIG. 12 is an explanatory view schematically illustrating the plurality of odd-numbered flow path walls and a plurality of even-numbered flow path walls which are formed in the bulkhead heat exchanger of the third embodiment.

FIG. 12 is an explanatory view schematically illustrating the plurality of odd-numbered flow path walls 81-1 to **81-*n*1 and the plurality of even-numbered flow path walls 82-1 to 82-*n*2 formed in the bulkhead heat exchanger of the third embodiment. As illustrated in FIG. 12, in one odd-numbered flow path wall element 83-1 of the plurality of odd-numbered flow path wall elements 83-1 to 83-*m*1, an in-element notch 89 (corresponding to an "in-element notch") is formed by removing a portion of the odd-numbered flow path wall element 83-1, and the odd-numbered flow path wall element 83-1 is divided into two. Similarly to the odd-numbered flow path wall element 83-1, in the other odd-numbered flow path wall elements different from the odd-numbered flow path wall element 83-1 of the plurality of odd-numbered flow path wall elements 83-1 to 83-*m*1 as well, the in-element notch 89 is formed by removing a portion of each of the other odd-numbered flow path wall elements, and each odd-numbered flow path wall element is divided into two. The in-element notch 89 is formed in the odd-numbered flow path wall element 83-1 so as to overlap an inflection point where a phase of a sine curve 51 is $n+2\pi i$, and for example, the in-element notch 89 is formed so as to overlap a portion of the sine curve 51 in which the phase corresponds to a range of 60° from $5\pi/6+2\pi i$ to $7\pi/6+2\pi i$. Moreover, the plurality of odd-numbered flow path wall elements 83-1 to 83-*m*1 are formed so as to overlap portions corresponding to the maximum point and the minimum point of the sine curve 51**, respectively.

Similarly to the odd-numbered flow path wall element 83-1, in one even-numbered flow path wall element 84-1 of the plurality of even-numbered flow path wall elements 84-1 to **84-*m*2, an in-element notch 90 (corresponding to an "in-element notch") is formed by removing a portion of the even-numbered flow path wall element 84-1, and the even-numbered flow path wall element 84-1 is divided into two. Similarly to the even-numbered flow path wall element 84-1, in the other even-numbered flow path wall elements different from the even-numbered flow path wall element 84-1 of the plurality of even-numbered flow path wall elements 84-1 to 84-*m*2 as well, the in-element notch 90 is formed by removing a portion of each of the other even-numbered flow path wall elements, and each even-numbered flow path wall element is divided into two. The in-element notch 90 is formed in the even-numbered flow path wall element 84-1 so as to overlap the inflection point where the phase of the sine curve 51 is $2\pi i$, and for example, the in-element notch 90 is formed so as to overlap a portion of the sine curve 51 in which the phase corresponds to a range of 600 from $-\pi/6+2\pi i$ to $\pi/6+2\pi i$. Moreover, the plurality of even-numbered flow path wall elements 84-1 to 84-*m*2 are formed so as to overlap portions corresponding to the maximum point and the minimum point of the sine curve 51**, respectively.

Figure 13:
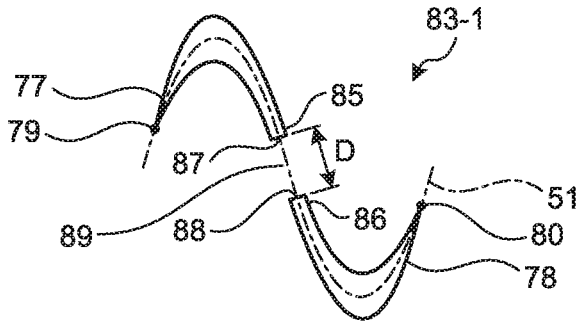
FIG. 13 is a plan view illustrating an odd-numbered flow path wall element.

FIG. 13 is a plan view illustrating the odd-numbered flow path wall element 83-1. As illustrated in FIG. 13, similarly to the odd-numbered flow path wall element 74-1 described above, the odd-numbered flow path wall element 83-1 is formed so as to conform to the sine curve 51 and includes a head 77 and a tail 78. The odd-numbered flow path wall element 83-1 includes a head-side edge portion 85 and a tail-side edge portion 86. The head-side edge portion 85 is adjacent to the in-element notch 89 and is disposed on the head 77 side from the in-element notch 89. The head-side edge portion 85 includes a head-side end surface 87 which faces the in-element notch 89. The head-side end surface 87 is formed along a plane orthogonal to the sine curve 51. The tail-side edge portion 86 is disposed on the tail 78 side from the in-element notch 89, and includes a tail-side end surface 88 which faces the in-element notch 89. The tail-side end surface 88 is formed along a plane orthogonal to the sine curve 51.

Similarly to the odd-numbered flow path wall element 83-1, in the odd-numbered flow path wall elements different from the odd-numbered flow path wall element 83-1 of the plurality of odd-numbered flow path wall elements 83-1 to **83-*m*1 as well, an in-element notch 89 is formed so as to overlap an inflection point of a sine curve to which the odd-numbered flow path wall element conforms. The plurality of even-numbered flow path wall elements 84-1 to 84-*m*2 are formed similarly to the plurality of odd-numbered flow path wall elements 83-1 to 83-*m*1, and each of the plurality of even-numbered flow path wall elements 84-1 to 84-*m*2 is formed of a flow path wall element which is mirror image symmetric to the odd-numbered flow path wall element 83-1. In the second heat exchanger plate of the bulkhead heat exchanger of the third embodiment as well, flow path walls similar to the plurality of odd-numbered flow path walls 81-1 to 81-*n*1 and the plurality of even-numbered flow path walls 82-1 to 82-*n*2 are formed in the second heat exchange flow path recess 36**.

Similarly to the bulkhead heat exchanger of the second embodiment described above, in the bulkhead heat exchanger of the third embodiment, the first fluid flows through the plurality of first flow paths, the second fluid flows through the plurality of second flow paths, and heat exchange is performed between the first fluid and the second fluid. Similarly to the bulkhead heat exchanger of the second embodiment described above, in the bulkhead heat exchanger of the third embodiment, the first fluid and the second fluid can be always disturbed locally, and it is possible to improve heat transfer performance in heat exchange between the first fluid and the second fluid. In the bulkhead heat exchanger of the third embodiment, wall surfaces of the plurality of odd-numbered flow path walls 81-1 to **81-*n*1 and the plurality of even-numbered flow path walls 82-1 to 82-*n*2 conform to a sine curve. Accordingly, similarly to the bulkhead heat exchanger of the second embodiment described above, it is possible to easily perform an operation of optimizing shapes of the plurality of odd-numbered flow path walls 81-1 to 81-*n*1 and the plurality of even-numbered flow path walls 82-1 to 82-*n*2**.

In the bulkhead heat exchanger of third embodiment, the plurality of in-element notches 89 are formed. Accordingly, compared to the bulkhead heat exchanger of the second embodiment described above, a frictional resistance when the first fluid flows through the plurality of first flow paths is reduced, and a pressure loss is reduced. In the bulkhead heat exchanger of the third embodiment, the head-side edge portion 85 and the tail-side edge portion 86 are formed. Accordingly, compared to the bulkhead heat exchanger of the second embodiment described above, an opportunity of generating a so-called leading edge effect increases, and it is possible to improve a heat transfer coefficient between the first fluid, and the first bulkhead 45 and the second bulkhead 61. Similarly, in the bulkhead heat exchanger of the third embodiment, it is possible to improve a heat transfer coefficient between the second fluid, and the first bulkhead 45 and the second bulkhead 61.

Fourth Embodiment

Figure 14:
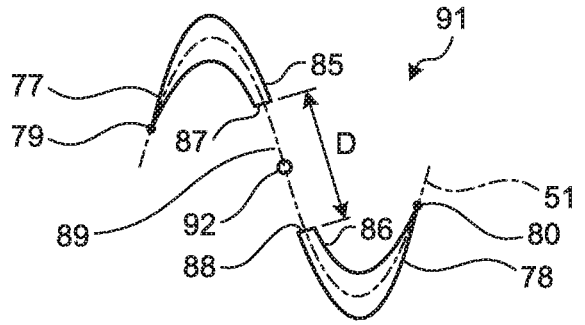
FIG. 14 is a plan view illustrating one odd-numbered flow path wall element among a plurality of odd-numbered flow path wall elements which are formed in the bulkhead heat exchanger of a fourth embodiment.

In a bulkhead heat exchanger of a fourth embodiment, the plurality of odd-numbered flow path wall elements 83-1 to **83-*m*1 of the bulkhead heat exchanger of the third embodiment described above are replaced with a plurality of other odd-numbered flow path wall elements, and the plurality of even-numbered flow path wall elements 84-1 to 84-*m*2 are replaced with a plurality of other even-numbered flow path wall elements. FIG. 14 is a plan view illustrating one odd-numbered flow path wall element 91 of the plurality of odd-numbered flow path wall elements formed in the bulkhead heat exchanger of the fourth embodiment. As illustrated in FIG. 14, the odd-numbered flow path wall element 91 is formed similarly to the above-described odd-numbered flow path wall element 83-1 and includes a head 77 and a tail 78. Moreover, the odd-numbered flow path wall element 91 includes a head-side edge portion 85 and a tail-side edge portion 86. The odd-numbered flow path wall element 91 further includes an intermediate flow path wall element 92 (corresponding to "intermediate flow path wall element"). The intermediate flow path wall element 92 is formed in a columnar shape. The intermediate flow path wall element 92 is disposed in a region where an in-element notch 89 is formed, and is disposed so as to overlap an inflection point of a sine curve 51 to which the odd-numbered flow path wall element 91 conforms. In the odd-numbered flow path wall element 91, the intermediate flow path wall element 92 is provided. Accordingly, compared to the bulkhead heat exchanger of the above-described third embodiment illustrated in FIG. 13, it is possible to increase a length D of the in-element notch 89 which is a distance between the head-side edge portion 85 and the tail-side edge portion 86. Similarly to the odd-numbered flow path wall element 91, each of the other flow path wall elements different from the odd-numbered flow path wall element 91 of the plurality of flow path wall elements also includes the intermediate flow path wall element 92. That is, the intermediate flow path wall element 92 is periodically formed at each period T in each of the plurality of flow path walls of the bulkhead heat exchanger of the third embodiment described above. The plurality of even-numbered flow path wall elements are formed similarly to the plurality of odd-numbered flow path wall elements, and each of the plurality of even-numbered flow path wall elements is formed of a flow path wall element which is mirror image symmetrical to the odd-numbered flow path wall element 91**.

Similarly to the bulkhead heat exchanger of the third embodiment described above, in the bulkhead heat exchanger of the fourth embodiment, heat exchange is performed between the first fluid and the second fluid. Similarly to the bulkhead heat exchanger of the third embodiment described above, in the bulkhead heat exchanger of the fourth embodiment, the first fluid and the second fluid can be always disturbed locally, and it is possible to improve heat transfer performance in heat exchange between the first fluid and the second fluid.

In the bulkhead heat exchanger of the fourth embodiment, the intermediate flow path wall element 92 is formed and the length D of the in-element notch 89 increases. Accordingly, compared to the bulkhead heat exchanger of the third embodiment, it is possible to reduce a frictional resistance caused by the flow path wall when the fluid flows through the flow path. In addition, the intermediate flow path wall element 92 guides the flow of the fluid flowing along the odd-numbered flow path wall element 91, and the length D of the in-element notch 89 increases. Accordingly, a decrease in strength of the flow path wall is suppressed.

Meanwhile, the intermediate flow path wall element 92 is disposed so as to overlap the inflection point of the sine curve 51 to which the odd-numbered flow path wall element 91 conforms. However, the intermediate flow path wall element 92 may be formed so as not to overlap the inflection point. Even when the intermediate flow path wall element 92 is formed so as not to overlap the inflection point, the intermediate flow path wall element 92 is disposed in the region where the in-element notch 89 is formed. Accordingly, it is possible to reduce an impact that the head-side edge portion 85 and the tail-side edge portion 86 receive from the first fluid. Further, the intermediate flow path wall element 92 is formed in the columnar shape. However, the intermediate flow path wall element 92 may be formed in a shape other than the columnar shape. Even when the intermediate flow path wall element 92 is formed in a shape other than the columnar shape, it is possible to reduce the impact that the head-side edge portion 85 and the tail-side edge portion 86 receive from the first fluid.

Figure 15:
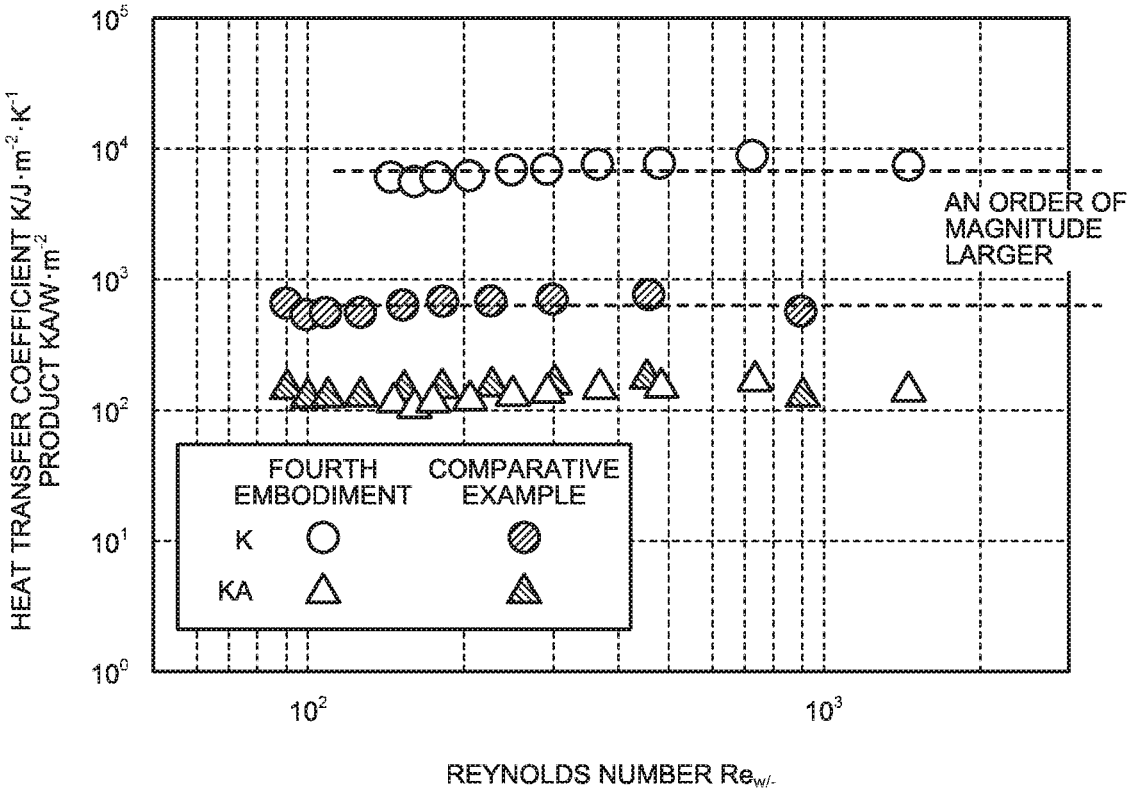
FIG. 15 is a graph illustrating a heat transfer coefficient K and a product KA of the heat transfer coefficient K and a heat transfer area in the bulkhead heat exchanger of the fourth embodiment and a bulkhead heat exchanger of a comparative example.

FIG. 15 is a graph illustrating a heat transfer coefficient K and a product KA of the heat transfer coefficient K and a heat transfer area in the bulkhead heat exchanger of the fourth embodiment and a bulkhead heat exchanger of a comparative example. The bulkhead heat exchanger of the comparative example is a so-called plate heat exchanger. The graph of FIG. 15 illustrates that the product KA in the bulkhead heat exchanger of the fourth embodiment and the product KA in the bulkhead heat exchanger of the comparative example are approximately the same as each other, and illustrates that the bulkhead heat exchanger of the comparative example has a heat exchange capacity equivalent to that of the bulkhead heat exchanger of the fourth embodiment. The graph of FIG. 15 illustrates that the heat transfer coefficient K of the bulkhead heat exchanger of the fourth embodiment is approximately 10 times the heat transfer coefficient K of the bulkhead heat exchanger of the comparative example, and illustrates that the heat transfer coefficient K of the bulkhead heat exchanger of the fourth embodiment is larger than the heat transfer coefficient K of the bulkhead heat exchanger of the comparative example. That is, the graph of FIG. 15 illustrates that the bulkhead heat exchanger of the fourth embodiment exchanges heat has high heat transfer performance for heat exchange compared to the plate heat exchanger having the heat exchange capacity equivalent to that of the bulkhead heat exchanger of the fourth embodiment.

Figure 16:
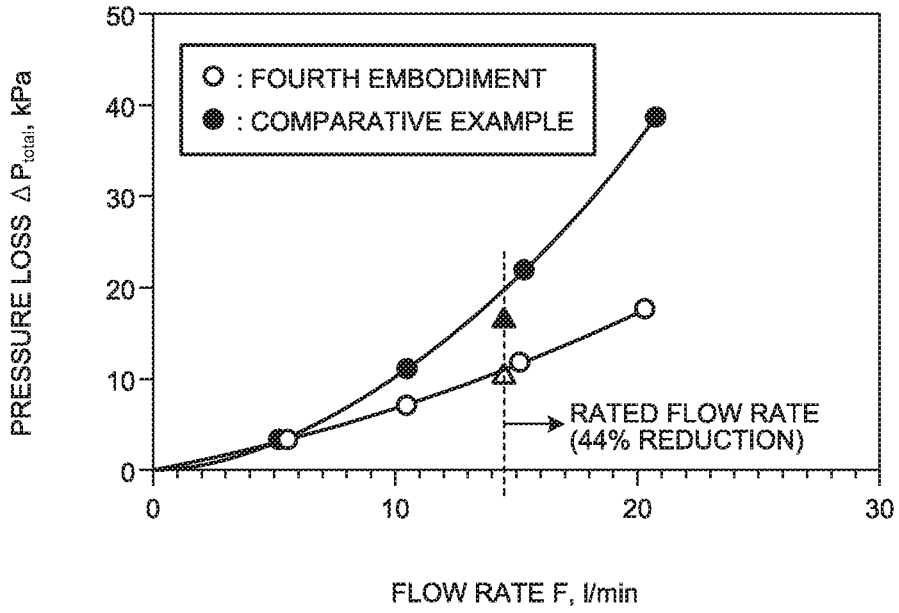
FIG. 16 is a graph illustrating a pressure loss of the bulkhead heat exchanger of the fourth embodiment and a pressure loss of a bulkhead heat exchanger of a comparative example.

FIG. 16 is a graph illustrating a pressure loss of the bulkhead heat exchanger of the fourth embodiment and a pressure loss of the bulkhead heat exchanger of the comparative example. The graph of FIG. 16 illustrates that the pressure loss of the bulkhead heat exchanger of the fourth embodiment is 44% of the pressure loss of the bulkhead heat exchanger of the comparative example, and illustrates that the pressure loss of the bulkhead heat exchanger of the fourth embodiment can be reduced compared to the bulkhead heat exchanger of the comparative example. The reason why the pressure loss of the bulkhead heat exchanger of the fourth embodiment is reduced is that a hydraulic diameter of the flow path of the bulkhead heat exchanger of the fourth embodiment is smaller than 1.0 mm and is smaller than a hydraulic diameter of the flow path of the bulkhead heat exchanger of the comparative example. Moreover, the reason why the pressure loss of the bulkhead heat exchanger of the fourth embodiment is reduced is that the plurality of odd-numbered notches 73 and the plurality of in-element notches 89 are formed in the plurality of odd-numbered flow path walls, and the plurality of even-numbered notches 75 and the plurality of in-element notches 90 are formed in the plurality of even-numbered flow path walls.

Figure 17:
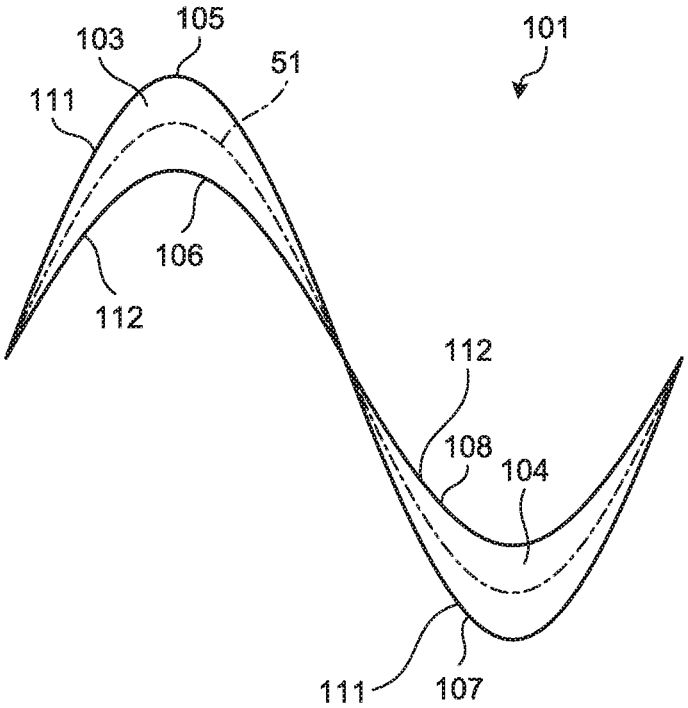
FIG. 17 is a plan view illustrating a portion of one flow path wall included in a bulkhead heat exchanger of a modification example.

Meanwhile, in the plurality of first flow path walls 48-1 to **48-*n* of the bulkhead heat exchanger of the embodiment, the first side flow path wall surface 52 and the second side flow path wall surface 53 are formed so as to conform to two sine curves obtained by offsetting the sine curve 51 where the plurality of first flow path walls 48-1 to 48-*n* overlap, respectively. However, the first side flow path wall surface 52 and the second side flow path wall surface 53 may be formed so as to conform to two sine curves obtained by changing the amplitude of the sine curve 51. FIG. 17 is a plan view illustrating a portion of one flow path wall included in a bulkhead heat exchanger of a modification example. As illustrated in FIG. 17, a flow path wall 101 is formed so as to conform to the sine curve 51 and is formed of a plurality of first side portions 103 and a plurality of second side portions 104. The plurality of first side portions 103 overlap a portion of the sine curve 51 which is convex upward. The plurality of second side portions 104 overlap a portion of the sine curve 51 which is convex downward. The plurality of first side portions 103 include a first convex flow path wall surface 105 and a first concave flow path wall surface 106. The first convex flow path wall surface 105 is formed on a first sidewall 46 side of the plurality of first side portions 103. The first concave flow path wall surface 106 is formed on a second sidewall 47 side of the plurality of first side portions 103**.

The plurality of second side portions 104 include a second convex flow path wall surface 107 and a second concave flow path wall surface 108. The second convex flow path wall surface 107 is formed on the second sidewall 47 side of the plurality of second side portions 104. The second concave flow path wall surface 108 is formed on the first sidewall 46 side of the plurality of second side portions 104.

The first convex flow path wall surface 105 and the second convex flow path wall surface 107 (corresponding to a "first wall surface") are formed so as to conform to one sine curve 111 (corresponding to a "first sine curve"). The sine curve 111 is formed so that a period of the sine curve 111 is equal to the period of the sine curve 51. In addition, the sine curve 111 is formed so that an amplitude of the sine curve 111 is larger than the amplitude of the sine curve 51. For example, the sine curve 111 is formed so that the amplitude of the sine curve 111 is equal to numeric multiples greater than 1 (for example, 1.2 times) the amplitude A of the sine curve 51. Moreover, the sine curve 111 is formed so that a plurality of inflection points of the sine curve 111 overlap a plurality of inflection points of the sine curve 51 and that the sine curve 111 intersects the sine curve 51 at the plurality of inflection points of the sine curve 111.

The first concave flow path wall surface 106 and the second concave flow path wall surface 108 (corresponding to a "second wall surface") are formed so as to conform to one sine curve 112 (corresponding to a "second sine curve"). The sine curve 112 is formed so that a period of the sine curve 112 is equal to the period of the sine curve 51. In addition, the sine curve 112 is formed so that an amplitude of the sine curve 112 is smaller than the amplitude of the sine curve 51. For example, the sine curve 112 is formed so that the amplitude of the sine curve 112 is equal to positive number times less than 1 (for example, 0.8 times) the amplitude A of the sine curve 51. That is, the sine curve 112 is formed so that the period of the sine curve 112 is equal to the period of the sine curve 111, and the amplitude of the sine curve 112 is smaller than the amplitude of the sine curve 111. Moreover, the sine curve 112 is formed so that a plurality of inflection points of the sine curve 112 overlap the plurality of inflection points of the sine curve 51 and that the sine curve 112 intersects the sine curve 51 at the plurality of inflection points of the sine curve 112. That is, the sine curve 112 is formed so that the plurality of inflection points of the sine curve 112 overlap the plurality of inflection points of the sine curve 111 and that the sine curve 112 intersects the sine curve 111 at the plurality of inflection points of the sine curve 112.

In the bulkhead heat exchanger, even when the plurality of first flow path walls are replaced with the flow path walls 101, it is possible to change the flow direction of the first fluid in the plurality of first flow paths. Moreover, in the bulkhead heat exchanger, cross-sectional areas of the plurality of first flow paths are changed depending on the positions, and thus, it is possible to change the speed of the first fluid flowing through the plurality of first flow paths. In addition, in the bulkhead heat exchanger, even when the plurality of second flow path walls are replaced with the flow path walls 101, it is possible to change the flow direction of the second fluid in the plurality of second flow paths. Moreover, in the bulkhead heat exchanger, cross-sectional areas of the plurality of second flow paths are changed depending on the positions, and thus, it is possible to change the speed of the second fluid flowing through the plurality of second flow paths. As a result, in the bulkhead heat exchanger, similarly to the bulkhead heat exchanger of the embodiments described above, the first fluid and the second fluid flowing through the plurality of first flow paths and the plurality of second flow paths, respectively are always disturbed locally, and thus, it is possible to improve heat transfer performance in heat exchange between the first fluid and the second fluid. In the bulkhead heat exchanger, similarly to the bulkhead heat exchangers of the embodiments described above, the plurality of notches or the intermediate flow path wall elements are provided in the flow path wall 101. Accordingly, the friction resistance is reduced, the leading edge effect is exerted, a shape loss is reduced, and it is possible to improve the heat transfer performance in the heat exchange between the first fluid and the second fluid. Moreover, in the bulkhead heat exchanger, the wall surface of the flow path wall 101 conforms to the sine curve. Accordingly, similarly to the bulkhead heat exchangers of the embodiments described above, it is possible to easily perform an operation of inputting/changing the shapes of the plurality of first flow paths and the plurality of second flow paths, and it is possible to easily perform the optimization of the shape by computer simulation.

Moreover, in the plurality of first flow path walls and the plurality of second flow path walls, widths thereof decrease toward the inflection point of the sine curve, and the plurality of first flow path walls and the plurality of second flow path walls are sharpened at a portion overlapping the inflection point of the sine curve. Therefore, the head 77 and the tail 78 of the flow path wall element of each of the bulkhead heat exchangers of the second to fourth embodiments can be formed so that the widths thereof more gently decrease toward the end of the flow path wall element when the plurality of first flow path walls and the plurality of second flow path walls are provided. In the bulkhead heat exchanger, the wall surface of the flow path wall element is formed more gently. Accordingly, compared to the bulkhead heat exchangers of the second embodiment to the fourth embodiment described above, in the first flow path and the second flow path, it is possible to reduce the shape loss represented by the shape loss coefficient which is one of the pressure losses in hydrodynamics and reduce the pressure loss between the first flow path and the second flow path.

Meanwhile, in the bulkhead heat exchangers of the second embodiment to the fourth embodiment described above, the head 77 and the tail 78 are formed so as to be sharpened.

However, the head 77 and the tail 78 may be formed so as not to be sharpened. Further, in the bulkhead heat exchanger of the above-described embodiments, both the first sidewall surface 41 and the second sidewall surface 42 conform to the sine curve. However, the first sidewall surface 41 and the second sidewall surface 42 may not conform to the sine curve, and for example, the first sidewall surface 41 and the second sidewall surface 42 may be formed to be substantially flat. Even in this case, in the bulkhead heat exchanger, the wall surfaces of the plurality of flow path walls conform to the sine curve. Accordingly, the fluid is always disturbed locally, the heat transfer performance can be improved, and it is possible to easily perform the operation of optimizing the shapes of the plurality of flow path walls.

Hereinbefore, the embodiments are described. However, the embodiments are not limited by the contents described above. Further, the components described above include components which can be easily conceived by those skilled in the art, components which are substantially the same, and components within the so-called equivalent range. Moreover, the components described above can be combined appropriately with each other. Furthermore, at least one of various omissions, substitutions, and modifications of the components can be made without departing from the spirit of the embodiments.

REFERENCE SIGNS LIST

1 BULKHEAD HEAT EXCHANGER
41 FIRST SIDEWALL SURFACE
42 SECOND SIDEWALL SURFACE
45 FIRST BULKHEAD
46 FIRST SIDEWALL
47 SECOND SIDEWALL
48-1 to **48-*n*** PLURALITY OF FIRST FLOW PATH WALLS
51 SINE CURVE
52 FIRST SIDE FLOW PATH WALL SURFACE
53 SECOND SIDE FLOW PATH WALL SURFACE
61 SECOND BULKHEAD
62-1 to **62-*n*** PLURALITY OF SECOND FLOW PATH WALLS
65 FIRST FLOW PATH
66 SECOND FLOW PATH
67 FIRST SPACE
68 SECOND SPACE
71-1 to **71-*n*1** PLURALITY OF ODD-NUMBERED FLOW PATH WALLS
72-1 to **72-*n*2** PLURALITY OF EVEN-NUMBERED FLOW PATH WALLS
73 ODD-NUMBERED NOTCH
74-1 to **74-*m*1** PLURALITY OF ODD-NUMBERED FLOW PATH WALL ELEMENTS
75 EVEN-NUMBERED NOTCH
76-1 to **76-*m*2** PLURALITY OF EVEN-NUMBERED FLOW PATH WALL ELEMENTS
79 ONE END
80 THE OTHER END
81-1 to **81-*n*1** PLURALITY OF ODD-NUMBERED FLOW PATH WALLS
82-1 to **82-*n*2** PLURALITY OF EVEN-NUMBERED FLOW PATH WALLS
83-1 to **83-*m*1** PLURALITY OF ODD-NUMBERED FLOW PATH WALL ELEMENTS
84-1 to **84-*m*2** PLURALITY OF EVEN-NUMBERED FLOW PATH WALL ELEMENTS
89 IN-ELEMENT NOTCH
90 IN-ELEMENT NOTCH
85 HEAD-SIDE EDGE PORTION
86 TAIL-SIDE EDGE PORTION
91 ODD-NUMBERED FLOW PATH WALL ELEMENT
92 INTERMEDIATE FLOW PATH WALL ELEMENT
101 FLOW PATH WALL
105 FIRST CONVEX FLOW PATH WALL SURFACE
106 FIRST CONCAVE FLOW PATH WALL SURFACE
107 SECOND CONVEX FLOW PATH WALL SURFACE
108 SECOND CONCAVE FLOW PATH WALL SURFACE
111 SINE CURVE
112 SINE CURVE

The invention claimed is:

1. A bulkhead heat exchanger comprising:

a first bulkhead;

a second bulkhead; and a plurality of flow path walls which divide a space formed between the first bulkhead and the second bulkhead into a plurality of adjacent first flow paths, wherein the first bulkhead and the second bulkhead separate the plurality of first flow paths from second flow paths through which a second fluid different from a first fluid flowing through the plurality of first flow paths flows, the plurality of flow path walls have a plurality of wall surfaces, the plurality of wall surfaces conform to sine curves different in position from each other, respectively, each of the plurality of flow path walls is divided into a plurality of flow path wall elements by forming a plurality of notches at each period of the sine curves, the plurality of notches overlapping inflection points of the sine curves, each of the plurality of flow path wall elements is further divided into a plurality of other flow path wall elements by forming an in-element notch, and the in-element notch overlaps another inflection point of the sine curves which is different from the inflection points where the notches overlap, each of the other flow path wall elements is formed not to overlap the inflection points of the sine curves and to overlap either maximum points or minimum points of the sine curves, one flow path of the plurality of first flow paths is connected, via the plurality of notches and the in-element notch formed on two flow path walls of the plurality of flow path walls, to two adjacent flow paths arranged respectively on both sides of the one flow path of the plurality of the first flow path, one of the two flow path walls separates the one flow path from one of the two flow paths, another one of the two flow path walls separates the one flow path from another one of the two flow paths, and the plurality of notches and the in-element notch are formed, such that two flow path wall elements are included in a plurality of elements obtained by dividing the plurality of flow path walls with the plurality of notches and the in-element notch, such that a straight line segment connecting the two flow path wall elements extends across more than three flow paths of the plurality of first flow paths without intersecting the plurality of elements, and such that a straight line parallel to an amplitude direction of the sine curves intersects the plurality of notches and the in-element notch without intersecting the plurality of elements.

2. The bulkhead heat exchanger according to claim 1, further comprising:

a sidewall which forms a sidewall surface on an end of the space, wherein the sidewall surface conforms to another sine curve having the same period as that of the sine curves.

3. The bulkhead heat exchanger according to claim 1, wherein the first flow path and the second flow path each has a hydraulic diameter of 0.3 mm or less.

4. A bulkhead heat exchanger comprising:

a first bulkhead;

a second bulkhead; and a plurality of flow path walls which divide a space formed between the first bulkhead and the second bulkhead into a plurality of first flow paths, wherein the first bulkhead and the second bulkhead separate the plurality of first flow paths from second flow paths through which a second fluid different from a first fluid flowing through the plurality of first flow paths flows, the plurality of flow path walls have a plurality of wall surfaces, the plurality of wall surfaces conform to sine curves different in position from each other, respectively, each of the plurality of flow path walls is divided into a plurality of flow path wall elements by forming a plurality of notches at each period of the sine curves, the plurality of notches overlapping inflection points of the sine curves, and each of the plurality of flow path wall elements overlaps with either maximum points or minimum points of the sine curves, and is further divided by forming an in-element notch overlapping another inflection point of the sine curves which is different from the inflection points where the notches overlap, each of the plurality of flow path wall element including an intermediate flow path wall element disposed in the in-element notch.

5. The bulkhead heat exchanger according to claim 4, wherein each of the plurality of flow path walls includes a first wall surface, and a second wall surface which is formed on a side opposite to the first wall surface, the sine curves include a first sine curve and a second sine curve, the first wall surface conforms to the first sine curve and the second wall surface conforms to the second sine curve, a period and an amplitude of the first sine curve are equal to a period and an amplitude of the second sine curve, and the first sine curve and the second sine curve are located at positions translated by a predetermined offset value in respective amplitude directions.

6. The bulkhead heat exchanger according to claim 4, wherein each of the plurality of flow path walls includes a first wall surface, and a second wall surface which is formed on a side opposite to the first wall surface, the sine curves include a first sine curve and a second sine curve, the first wall surface conforms to the first sine curve and the second wall surface conforms to the second sine curve, a period of the first sine curve is equal to a period of the second sine curve, an amplitude of the first sine curve is smaller than an amplitude of the second sine curve, and the first sine curve and the second sine curve intersect each other at respective inflection points.

7. The bulkhead heat exchanger according to claim 4, wherein the flow path wall element is formed so that a width thereof is gently reduced toward an end adjacent to the notches.

8. The bulkhead heat exchanger according to claim 4, further comprising:

a sidewall which forms a sidewall surface on an end of the space, wherein the sidewall surface conforms to another sine curve having the same period as that of the sine curves.

9. The bulkhead heat exchanger according to claim 4, wherein the first flow path and the second flow path each has a hydraulic diameter of 0.3 mm or less.

* * * * *